US012650009B2

(12) United States Patent
Bissell

(10) Patent No.: US 12,650,009 B2
(45) **Date of Patent: *Jun. 9, 2026**

(54) FIXTURE CARRIER

(71) Applicant: Zurn Water, LLC, Milwaukee, WI (US)

(72) Inventor: Donald J. Bissell, Erie, PA (US)

(73) Assignee: Zurn Water, LLC, Milwaukee, WI (US)

( * ) Notice: Subject to any disclaimer, the term of this patent is extended or adjusted under 35 U.S.C. 154(b) by 64 days.

This patent is subject to a terminal disclaimer.

(21) Appl. No.: 18/795,782

(22) Filed: Aug. 6, 2024

(65) Prior Publication Data

US 2024/0392551 A1 Nov. 28, 2024

Related U.S. Application Data

(63) Continuation of application No. 17/078,572, filed on Oct. 23, 2020, now Pat. No. 12,065,816.

(60) Provisional application No. 62/926,105, filed on Oct. 25, 2019.

(51) Int. Cl.
*E03C 1/328* (2006.01)
*E03D 11/13* (2006.01)

(52) U.S. Cl.
CPC ..... *E03C 1/328* (2013.01); *E03D 11/135* (2013.01)

(58) Field of Classification Search
CPC . E03C 1/32; E03C 1/326; E03C 1/328; E03D 11/135
USPC ..... 4/643, 645, 646; 248/149, 688
See application file for complete search history.

(56) References Cited

U.S. PATENT DOCUMENTS

| | | | |
|---|---|---|---|
| 832,182 | A | 10/1906 | Dimond |
| 899,956 | A | 9/1908 | Alfred et al. |
| 1,078,546 | A | 11/1913 | Mccarty et al. |
| 1,657,020 | A | 1/1928 | Mason |
| 1,930,314 | A | 10/1933 | Healy et al. |
| 2,264,082 | A | 11/1941 | Kintz |
| 2,283,794 | A | 5/1942 | Crozier |
| 2,716,757 | A | 9/1955 | Eriksson |
| 2,810,917 | A | 10/1957 | Rhoades, Jr. |
| 2,819,473 | A | 1/1958 | Baker et al. |
| 2,903,712 | A | 9/1959 | Morris et al. |
| 2,937,381 | A | 5/1960 | Manas |
| 2,938,381 | A | 5/1960 | Smith et al. |

(Continued)

OTHER PUBLICATIONS

Jay R. Smith Mfg. Co., Labor Savor for Wheelchair Lavatories—Floor Mounted, Product Literature Sheets, 2019 (5 Pages).

(Continued)

*Primary Examiner* — Tuan N Nguyen
(74) *Attorney, Agent, or Firm* — Husch Blackwell LLP

(57) ABSTRACT

A fixture carrier for supporting a plumbing fixture includes an upright defining a first axis, and a cross-bar coupled to the upright and defining a second axis oriented perpendicular to the first axis. The fixture carrier additionally includes an arm defining a third axis oriented perpendicular to the first axis and the second axis, a bracket removably coupled to the arm and configured to couple the arm to the upright, and a plate positioned between the bracket and the arm. The plate includes an aperture configured to receive a portion of the bracket. The plate is slidable along the aperture relative to the bracket in a direction parallel to the second axis.

20 Claims, 19 Drawing Sheets

(56) References Cited

U.S. PATENT DOCUMENTS

| | | | |
|---|---|---|---|
| 3,011,177 | A | 12/1961 | Haughey |
| 3,014,223 | A | 12/1961 | Pope |
| RE25,175 | E | 5/1962 | Nelson et al. |
| 3,098,242 | A | 7/1963 | Armbruster et al. |
| 3,273,173 | A | 9/1966 | Morris et al. |
| 3,286,280 | A | 11/1966 | Duggan |
| 3,323,143 | A | 6/1967 | Pope |
| 3,364,503 | A | 1/1968 | Mustee |
| 3,398,409 | A | 8/1968 | Pope |
| 3,440,670 | A | 4/1969 | Van |
| 3,611,451 | A | 10/1971 | Armstrong |
| 3,765,036 | A | 10/1973 | Dykstra |
| 3,810,597 | A | 5/1974 | Flegel et al. |
| 3,932,899 | A | 1/1976 | Brady et al. |
| 4,058,859 | A | 11/1977 | Arrowood |
| 4,158,898 | A | 6/1979 | Denhart |
| 4,434,516 | A | 3/1984 | Morris et al. |
| 4,541,602 | A | 9/1985 | Potzas |
| 4,979,239 | A | 12/1990 | Klein et al. |
| 5,044,584 | A | 9/1991 | Lin |
| 5,050,253 | A | 9/1991 | Wasek |
| 5,090,064 | A | 2/1992 | Breitenberger |
| 5,148,552 | A | 9/1992 | Kress et al. |
| 5,167,040 | A | 12/1992 | Lechner |
| 5,210,883 | A | 5/1993 | Weber et al. |
| 5,230,109 | A | 7/1993 | Zaccai et al. |
| 5,265,284 | A | 11/1993 | Dottori et al. |
| 5,407,171 | A | 4/1995 | Gonzalez |
| 5,491,932 | A | 2/1996 | Elliott |
| 5,617,962 | A | 4/1997 | Chen |
| 5,660,637 | A | 8/1997 | Dodge |
| 5,697,650 | A | 12/1997 | Brown |
| 5,724,773 | A | 3/1998 | Hall |
| 5,752,679 | A | 5/1998 | Thomason |
| 6,035,589 | A | 3/2000 | Schmucki et al. |
| 6,129,320 | A | 10/2000 | Warren-Pfaeffle |
| 6,131,957 | A | 10/2000 | Saito et al. |
| 6,301,838 | B1 | 10/2001 | Hall |
| 6,360,381 | B1 | 3/2002 | Fitzgerald |
| 6,460,204 | B1 | 10/2002 | Krist et al. |
| 6,803,521 | B2 | 10/2004 | Vrame |
| 6,820,290 | B1 | 11/2004 | Mullick et al. |
| 6,979,027 | B2 | 12/2005 | Hetzler et al. |
| 7,096,520 | B2 | 8/2006 | Nicolia et al. |
| 7,191,794 | B2 | 3/2007 | Hodges |
| 7,426,937 | B2 | 9/2008 | Doverspike |
| 7,458,389 | B2 | 12/2008 | Doverspike |
| 7,571,497 | B2 | 8/2009 | Hetzler et al. |
| 8,141,177 | B1 | 3/2012 | Majocka et al. |
| 8,356,367 | B2 | 1/2013 | Flynn |
| 8,359,678 | B1 | 1/2013 | Burdette |
| 8,544,121 | B1 | 10/2013 | Majocka et al. |
| 8,887,319 | B2 | 11/2014 | Whiteside |
| 9,328,493 | B2 | 5/2016 | Wroblewski et al. |
| 12,065,816 | B2 * | 8/2024 | Bissell ..... E03C 1/328 |
| 2004/0222179 | A1 | 11/2004 | Garcia |
| 2005/0251908 | A1 | 11/2005 | Doverspike |
| 2006/0102813 | A1 | 5/2006 | Hetzler et al. |
| 2009/0126103 | A1 | 5/2009 | Dietrich et al. |
| 2013/0205494 | A1 | 8/2013 | Whiteside |
| 2014/0020173 | A1 | 1/2014 | Sargiani |

OTHER PUBLICATIONS

Jay R. Smith Mfg. Co., "0710-M24 Labor Saver Upright Support-Floor Mounted," https://www.jrsmith.com/product.aspx?Productid=69>, web page publicly available before Apr. 1, 2020 (3 pages).

Jay R. Smith Mfg. Co., "The Labor Saver Fixture Support," Lavatory Support Flyer from <https://www.jrsmith.com/labor-saver0710-m24>, web page publicly available before Apr. 1, 2020 (1 page).

Josam, "17100 Concealed Arm Carrier—Labor Saving Product Enhancement," https://www.josam.com/17100-avatory-carrier/>, web page publicly available before Apr. 1, 2020 (1 page).

Mifab, "MC-41 Single Carrier with Concealed Arms," https://www.mifab.com/products/mc-41-single-carrier-with-concealed-arms/>, web page publicly available before Apr. 1, 2020 (2 pages).

Watts, "TCA-411 Floor Mounted Concealed Arm Track Lavatory Carrier," https://www.watts.com/products/drainagesolutions/fixture-carriers/tca-411 >, web page publicly available before Apr. 1, 2020 (1 page).

Zurn, "Z1231 Concealed Arm System Wall Lavatories," Specification Sheet, <https://www.zurn.com/media-library/web_documents/pdfs/specsheets/58855-pdf>, web page publicly available before Apr. 1, 2020 (1 page).

Zurn, "Z1231-EZR Concealed Arm Carrier System for Wall Hung Lavatory W/Adjustable Uprights & Header Plates," Specification Sheet, <https://www.zurn.com/media-library/web_documents/pdfs/specsheets/84450-pdf>, web page publicly available before Apr. 1, 2020 (1 page).

* cited by examiner

FIXTURE CARRIER

CROSS-REFERENCE TO RELATED APPLICATIONS

The present application is a continuation of U.S. patent application Ser. No. 17/078,572 filed on Oct. 23, 2020, which claims priority to U.S. Provisional Patent Application No. 62/926,105, filed on Oct. 25, 2019. The entire contents of these applications are incorporated herein by reference.

FIELD OF THE INVENTION

The present disclosure relates to a fixture carrier for supporting a plumbing fixture, and more specifically, to a fixture carrier including an adjustable frame to accommodate plumbing fixtures of different sizes.

BACKGROUND

Fixture carriers are used to support plumbing fixtures, such as service sinks, lavatories, urinals, water coolers, etc. during installation. Fixture carriers typically include a stationary frame configured to support plumbing fixtures of a specific shape and size. As such, when installing plumbing fixtures of different sizes, a user may need to use various different fixture carriers which accommodate different size capacities.

SUMMARY

The present disclosure relates to a fixture carrier that includes mechanisms for adjusting components in x, y, and z directions to accommodate fixtures of different sizes for proper installation. The fixture carrier can accommodate fixtures from different manufacturers by making various adjustments to the components in one or more of the x, y, or z directions.

In one aspect, the present disclosure provides a fixture carrier for supporting a plumbing fixture, including an upright defining a first axis, a cross-bar coupled to the upright and defining a second axis oriented perpendicular to the first axis, an arm defining a third axis oriented perpendicular to the first axis and the second axis, a bracket removably coupled to the arm and configured to couple the arm to the upright, and a plate positioned between the bracket and the arm, wherein the plate includes an aperture configured to receive a portion of the bracket, wherein the plate is slidable along the aperture relative to the bracket in a direction parallel to the second axis.

In another aspect, the present disclosure provides a fixture carrier for supporting a plumbing fixture, including an upright defining a first axis, a cross-bar coupled to the upright and defining a second axis oriented perpendicular to the first axis, an arm defining a third axis oriented perpendicular to the first axis and the second axis, a sleeve positioned on the arm and slidable along the arm in a direction parallel to the third axis, and a coupling mechanism configured to couple the arm to the upright, the coupling mechanism including a bracket coupled to the upright and movable in a direction parallel to and coaxial with the first axis, and a plate positioned between the bracket and the arm, wherein the plate is coupled to the arm and movable relative to the bracket in a direction parallel to the second axis.

In yet another aspect, the present disclosure provides a fixture carrier for supporting a plumbing fixture, including an upright defining a first axis, a cross bar coupled to the upright and defining a second axis, an arm defining a third axis, and a coupling mechanism configured to couple the arm to the upright, the coupling mechanism including a bracket removably coupled to the upright, and a plate positioned between the bracket and the arm, wherein the coupling mechanism is movable relative to upright in a first direction parallel to the first axis, and wherein the plate is movable relative to the upright in a second direction parallel to the second axis.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

The figures and accompanying description provide adjustable fixture carriers that are configured to accommodate various sized plumbing fixtures, such as service sinks, lavatories, urinals, water coolers, etc. The adjustable fixture carriers also incorporate simplified structures to provide labor and installation cost savings.

Figure 1:
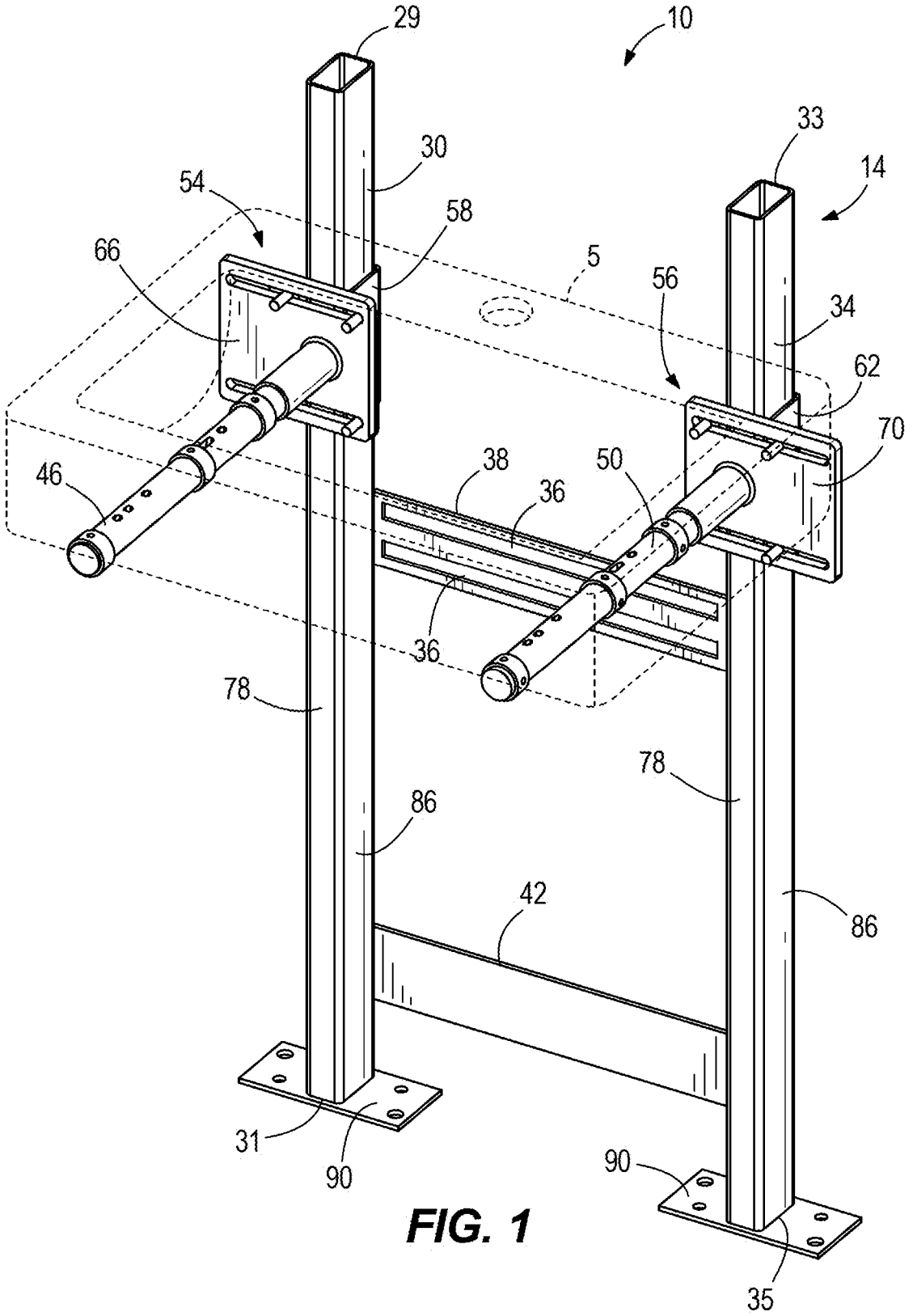
FIG. 1 is a front perspective view of a fixture carrier for supporting a plumbing fixture according to an embodiment of the present disclosure.
Figure 2:
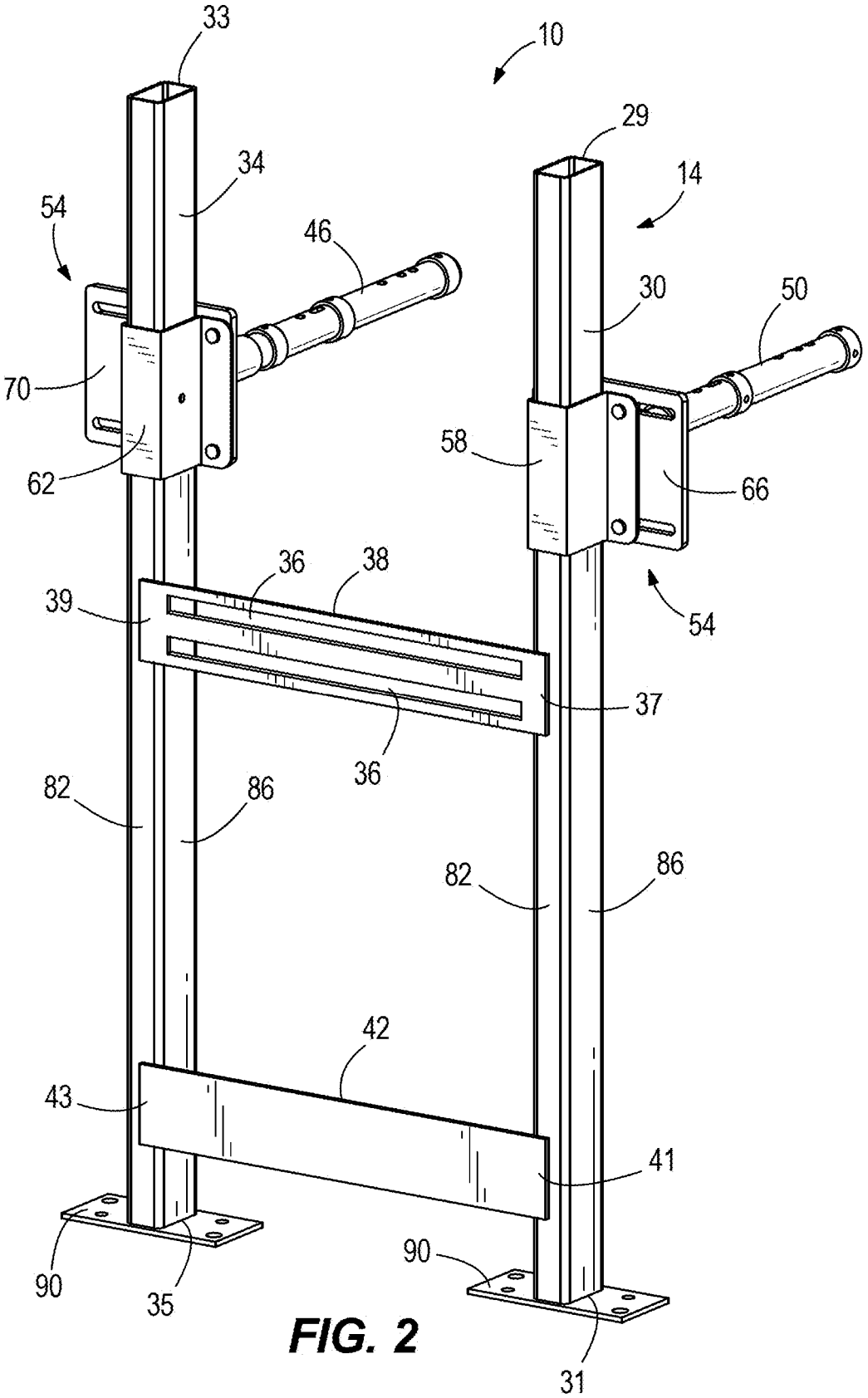
FIG. 2 is a rear perspective view of the fixture carrier of FIG. 1.
Figure 3:
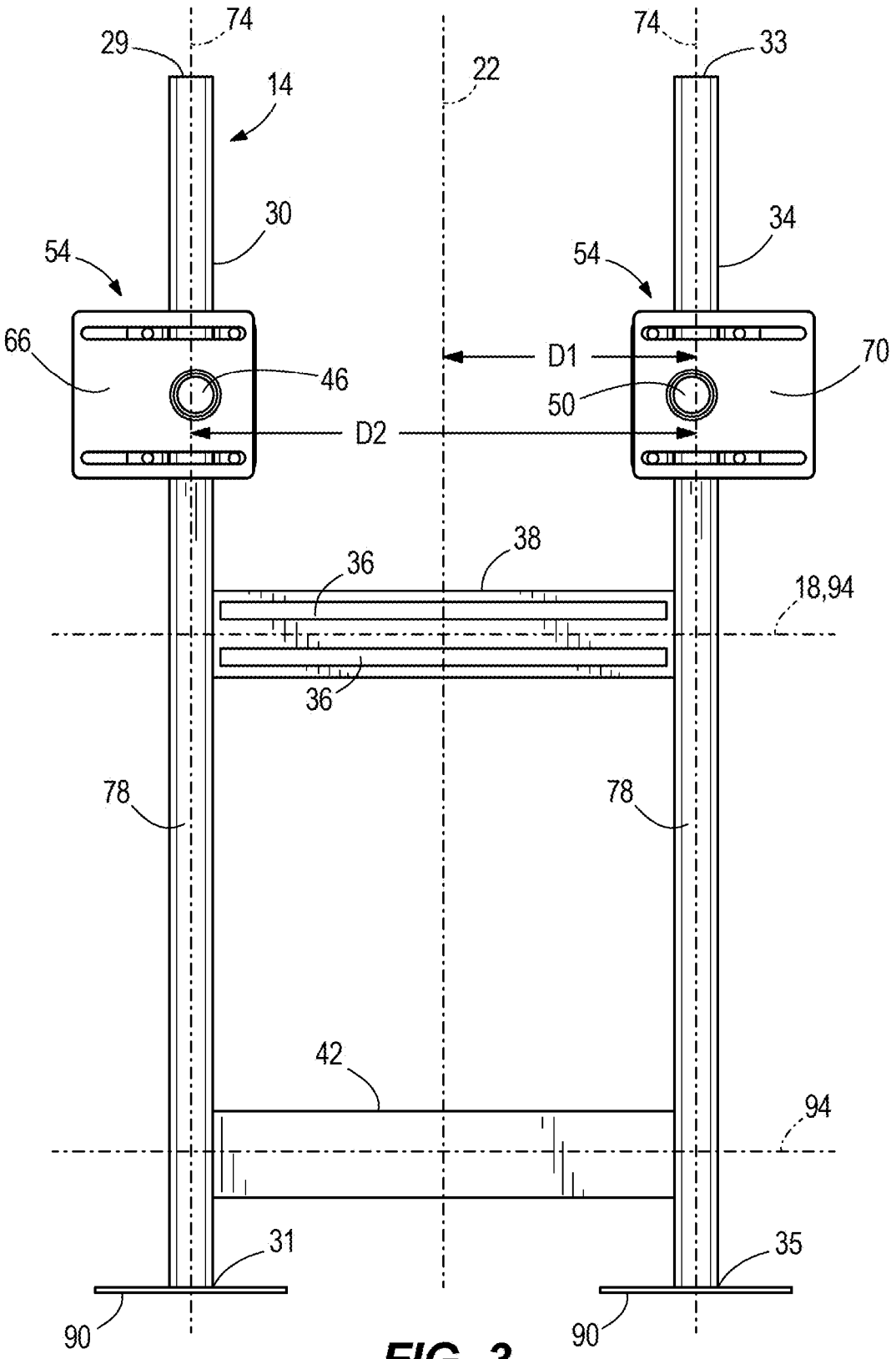
FIG. 3 is a front view of the fixture carrier of FIG. 1.
Figure 4:
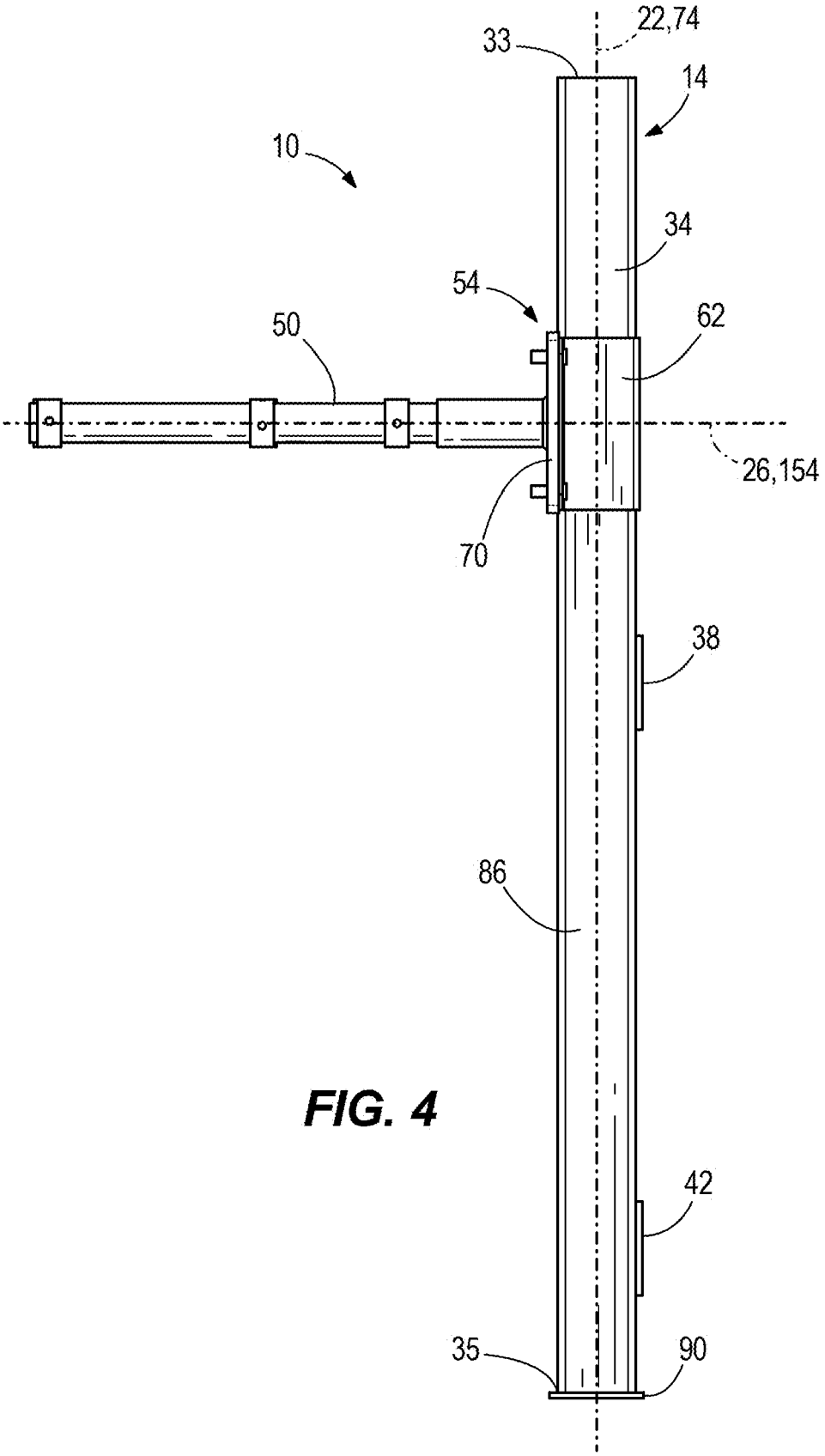
FIG. 4 is a side view of the fixture carrier of FIG. 1.

FIGS. 1-4 illustrate a fixture carrier 10 according to an embodiment of the present disclosure. The fixture carrier 10 includes a frame 14 which is adjustable in order to accommodate plumbing fixtures (e.g., plumbing fixture 5) of various sizes. Specifically, the frame 14 is adjustable in a horizontal direction and a vertical direction. With reference to FIG. 3, the horizontal direction is a direction extending along an X-axis 18, and the vertical direction is a direction extending along a Y-axis 22. The frame 14 is also adjustable in a direction extending along a Z-axis 26 (FIG. 4).

With reference to FIGS. 1-3, the frame 14 includes a first upright 30, a second upright 34 horizontally spaced a distance from the first upright 30, a first, or upper, cross-bar 38, and a second, or lower, cross-bar 42. In one construction, the first upright 30 and the second upright 34 are at a fixed distance of 17 inches on center. The first cross-bar 38 is secured to the first upright 30 and the second upright 34. Similarly, the second cross-bar 42 is secured to the first upright 30 and the second upright 34. The frame 14 additionally includes a first arm 46 and a second arm 50 configured to support the fixture 5 being installed. The first arm 46 is adjustably coupled to the first upright 30 with a first coupling mechanism 54. The first coupling mechanism 54 includes a first bracket 58 and a first plate 66. The second arm 50 is adjustably coupled to the second upright 34 with a second coupling mechanism 56. The second coupling mechanism 56 includes a second bracket 62 and a second plate 70.

The first upright 30 and the second upright 34 are substantially identical, elongate beams. The first upright 30 includes a first end 33 and an opposite second end 35. The second upright 34 includes a first end 29 and an opposite second end 31. In the illustrated embodiments, the uprights 30, 34 are hollow and rectangular in cross-section. However, in alternative embodiments, the uprights 30, 34 may be solid and may include an alternative shape. Each of the uprights 30, 34 includes a longitudinal axis 74 (FIG. 3) extending through the first ends 29, 33 and the second ends 31, 35, respectively, such that the longitudinal axes 74 are substantially parallel to the Y-axis 22. Each upright 30, 34 includes a front face 78, a back face 82, and two side faces 86. The front and back faces 78, 82 are parallel to each other. The two side faces 86 are also parallel to each other and are perpendicular to the front and back faces 78, 82. Each of the uprights 30, 34 additionally include a foot 90 positioned on the second end 31, 35 of each of the uprights 30, 34. The feet 90 are substantially rectangular plates configured to engage a work surface and support the fixture carrier 10 during use. The feet 90 may include apertures configured to receive a bolt, screw, nail or the like to secure the feet to the work surface, i.e., ground surface. In some embodiments, the uprights 30, 34 may include an aperture or a sleeve sized to receive a waste line. For example, a waste line sleeve may be a separate component that is incorporated (e.g., welded, bolted, connected, coupled) into the uprights 30, 34.

Each of the cross-bars 38, 42 are rectangular and planar. The first cross-bar 38 extends between and is coupled to the first and second uprights 30, 34. The first cross-bar 38 includes a first end 37 coupled to the first upright 30 and a second end 39 coupled to the second upright 34. Two elongate slots 36 extend through the cross-bar 38 from the first end 37 to the second end 39. In other embodiments, the first cross-bar 38 may include fewer or additional slots. The second cross-bar 42 also extends between and is coupled to the first and second uprights 30, 34. The second cross-bar 42 includes a first end 41 coupled to the first upright 30 and a second end 43 coupled to the second upright 34. Each of the cross-bars 38, 42 includes a horizontal axis 94 extending through the first end 37, 41 and the second ends 39, 43. With continued reference to FIG. 3, the horizontal axes 94 are substantially parallel to the X-axis 18, and perpendicular relative to the Y-axis 22 and Z-axis 26. More specifically, the horizontal axis 94 of the first cross-bar 38 is coaxial with the X-axis 18. The first ends 37, 41 of each of the cross-bars 38, 42 are coupled to the back face 82 of the first upright 30 and the second ends 39, 43 of each of the cross-bars 38, 42 are coupled to the back face 82 of the second upright 34. The first cross-bar 38 is coupled to the uprights 30, 34 closer to the first ends 29, 33 of the uprights 30, 34, and the second cross-bar 42 is coupled to the uprights 30, 34 closer to the second ends 31, 35 of the uprights 30, 34. In the illustrated embodiments, the cross-bars 38, 42 are permanently coupled to the uprights 30, 34. However, in alternative embodiments, the cross-bars 38, 42 may be removably coupled to the uprights 38, 42.

Figure 5B:
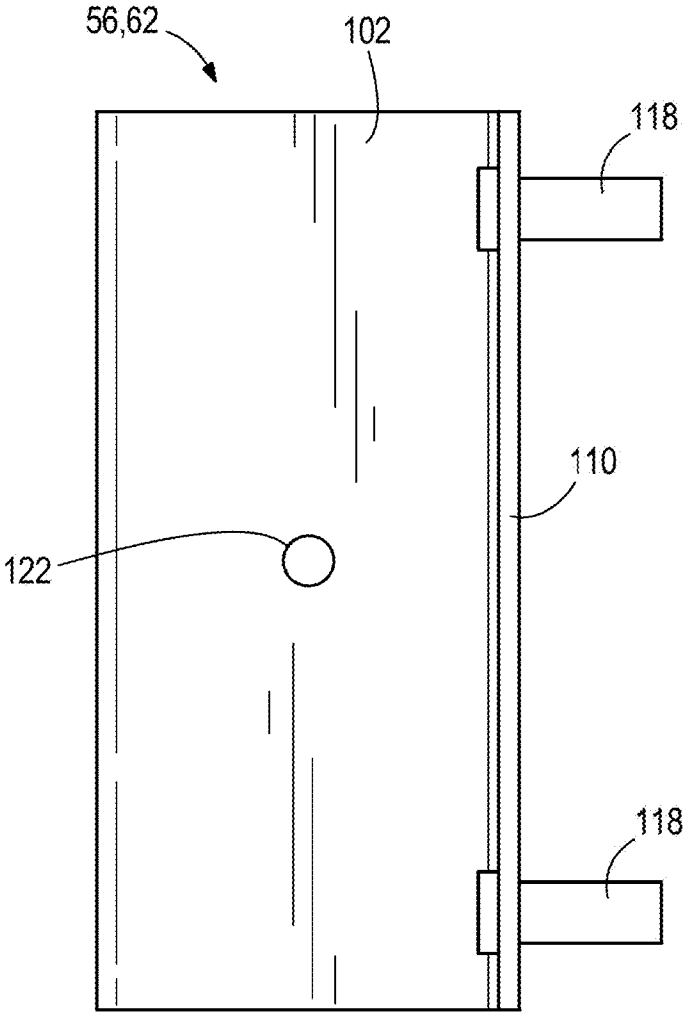
FIG. 5B is a side view of the bracket of FIG. 5A.
Figure 5A:
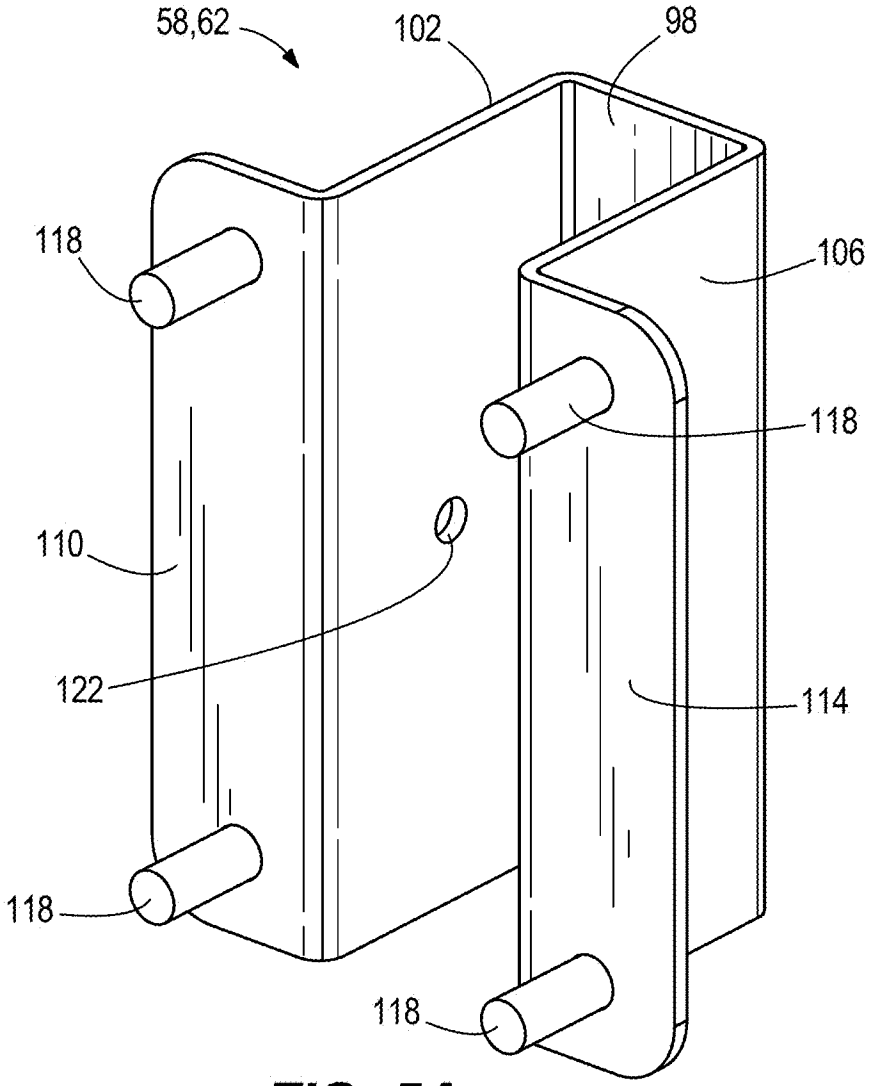
FIG. 5A is perspective view of a bracket of the fixture carrier of FIG. 1.

The first and second brackets 58, 62 are removably coupled to the uprights 30, 34 and vertically moveable to a position between the first end 29, 33 of the uprights 30, 34 and the first cross-bar 38. Specifically, the first bracket 58 is coupled to the first upright 30 and the second bracket 62 is coupled to the second upright 34. With reference to FIGS. 5A and 5B, each of the brackets 58, 62 are U-shaped and include a main portion 98, a first side portion 102, and a second side portion 106. Each bracket 58, 62 additionally includes a first flange 110 extending from the first side portion 102 and a second flange 114 extending from the second side portion 106. The first flange 110 is perpendicular relative to the first side portion 102, and the second flange 114 is perpendicular relative to the second side portion 106. Each of the flanges 110, 114 includes two studs 118 extending from the bracket 58, 62 for securing the brackets 58, 62 to the plates 66, 70. In some embodiments, the brackets 58, 62 may alternatively include two U-bolts to secure the brackets 58, 62 to the plates 66, 70. In such instances, each U-bolt extends between the first and second flanges 110, 114. In still further embodiments, the two U-bolts may be welded together to form a U-bolt assembly. The U-bolt assembly may then be secured to the brackets 58, 62 to secure the brackets 58, 62 to the plates 66, 70. In the illustrated embodiments, the brackets 58, 62 comprise a cast iron or steel material. However, in alternative embodiments, the brackets 58, 62 may comprise other suitable materials or combination of materials.

With continued reference to FIGS. 5A and 5B, the first side plate 102 of the brackets 58, 62 additionally includes an aperture 122 extending therethrough. The aperture 122 is sized to receive a set screw when positioning the bracket 58, 62 on the frame 14. More specifically, when positioning the bracket 58, 62 on the upright 30, 34, the user may slide the bracket 58, 62 along the longitudinal axis 74 to a desired position. Then, the user may insert a set screw into the aperture 122, thereby securing the brackets 58, 62 against the uprights 30, 34 and preventing movement of the brackets 58, 62 in either a horizontal or vertical direction. In the illustrated embodiments, the brackets 58, 62 include an aperture. In alternative embodiments, the brackets 58, 62 may include additional apertures configured to receive set screws. The brackets 58, 62 are shaped and sized to receive the uprights 30, 34. In the illustrated embodiments, the brackets 58, 62 are sized to receive a 1.5 inch×2.5 inch sized upright. However, in alternative embodiments the brackets 58, 62 may be sized to receive uprights of alternative sizes. In alternative embodiments, the brackets 58, 62 may be replaced by a clamp (e.g., a bike clamp) coupleable with the uprights 30, 34. In such instances, each clamp is positioned around the upright 30, 34 and supports the plate 66, 70 and/or the arm 46, 50. The clamp may be manually tightened (e.g., clamped) by the user, thereby applying a compression force to the upright 30, 34 and securing the position of the clamp relative to the upright 30, 34. Alternatively, the clamp may be manually loosened by the user so the user can vertically align the clamp along the upright 30, 34.

Figure 8:
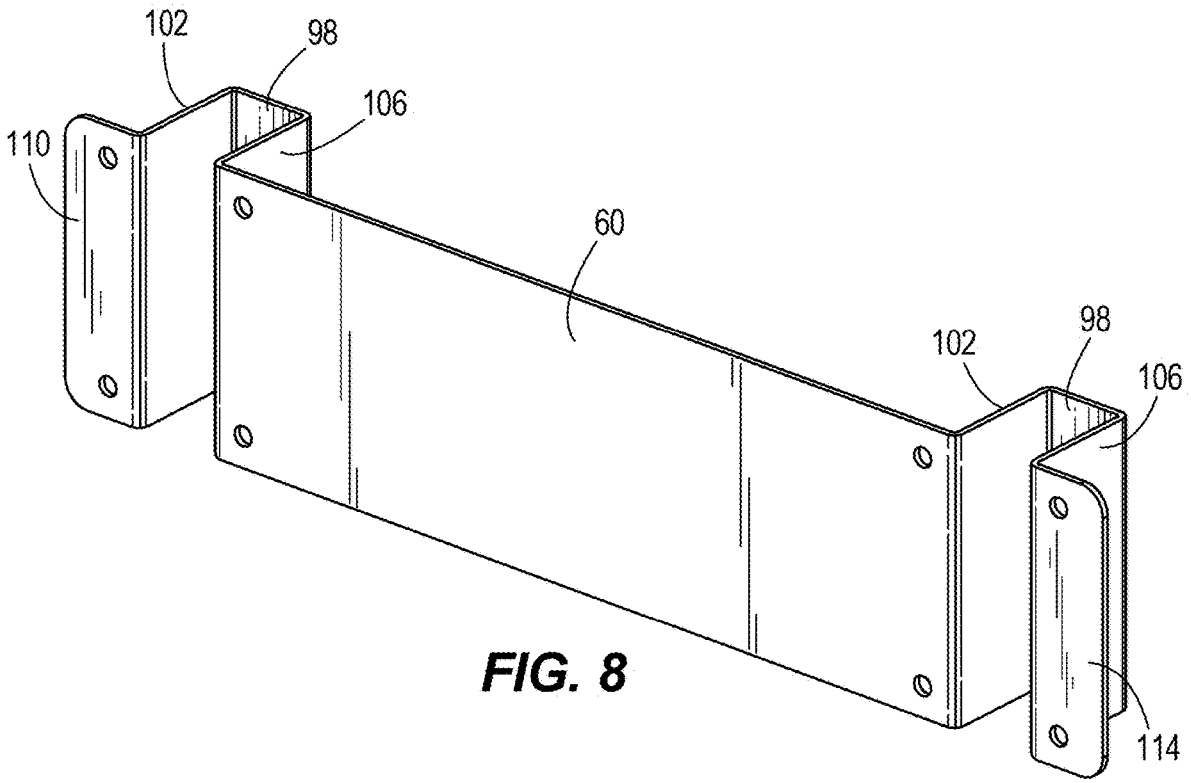
FIG. 8 is a front perspective view of an alternative bracket for use with the fixture carrier of FIG. 1.

Alternatively, as illustrated in FIG. 8, the first bracket 58 and the second bracket 62 may be integrally formed. More specifically, the second flange 114 of the first bracket 58 and the first flange 110 of the second bracket 62 are replaced by a single, elongate flange 60 connecting the first and second brackets 58, 62. In such instances, the first bracket 58 and the second bracket 62 are movable as a single unit relative to the uprights 30, 34.

Figure 9:
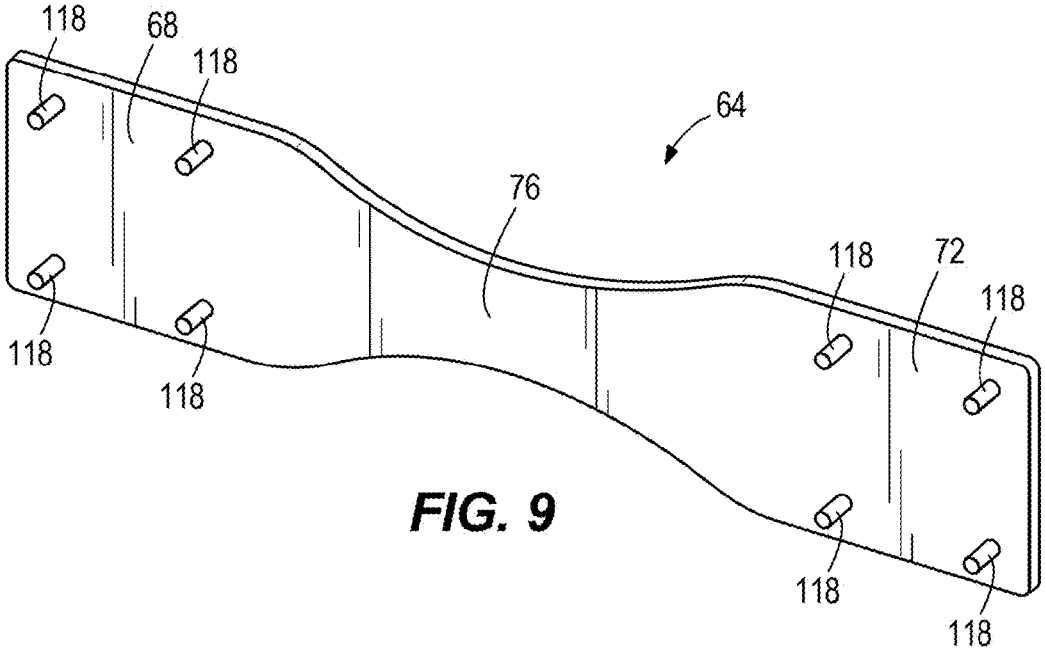
FIG. 9 is a front perspective view of another alternative bracket for use with the fixture carrier of FIG. 1.

In further alternative embodiments, as illustrated in FIG. 9, the brackets 58, 62 may be replaced by a single bracket 64. In such instances, the bracket 64 is removably coupled to the first upright 30 and the second upright 34. The user may vertically move the bracket 64 to a position between the first end 29, 33 of the uprights 30, 34 and the first cross-bar 38. The user may selectively fix the bracket 64 to the front face of the uprights 30, 34 at a desired position via a fastener. The bracket 64 is rectangular and includes a first side portion 68, a second side portion 72, and a middle concave portion 76. The first side portion 68 and the second side portion 72 include four studs 118 extending from the bracket 64 for securing the bracket 64 to the plates 66, 70.

Figure 10:
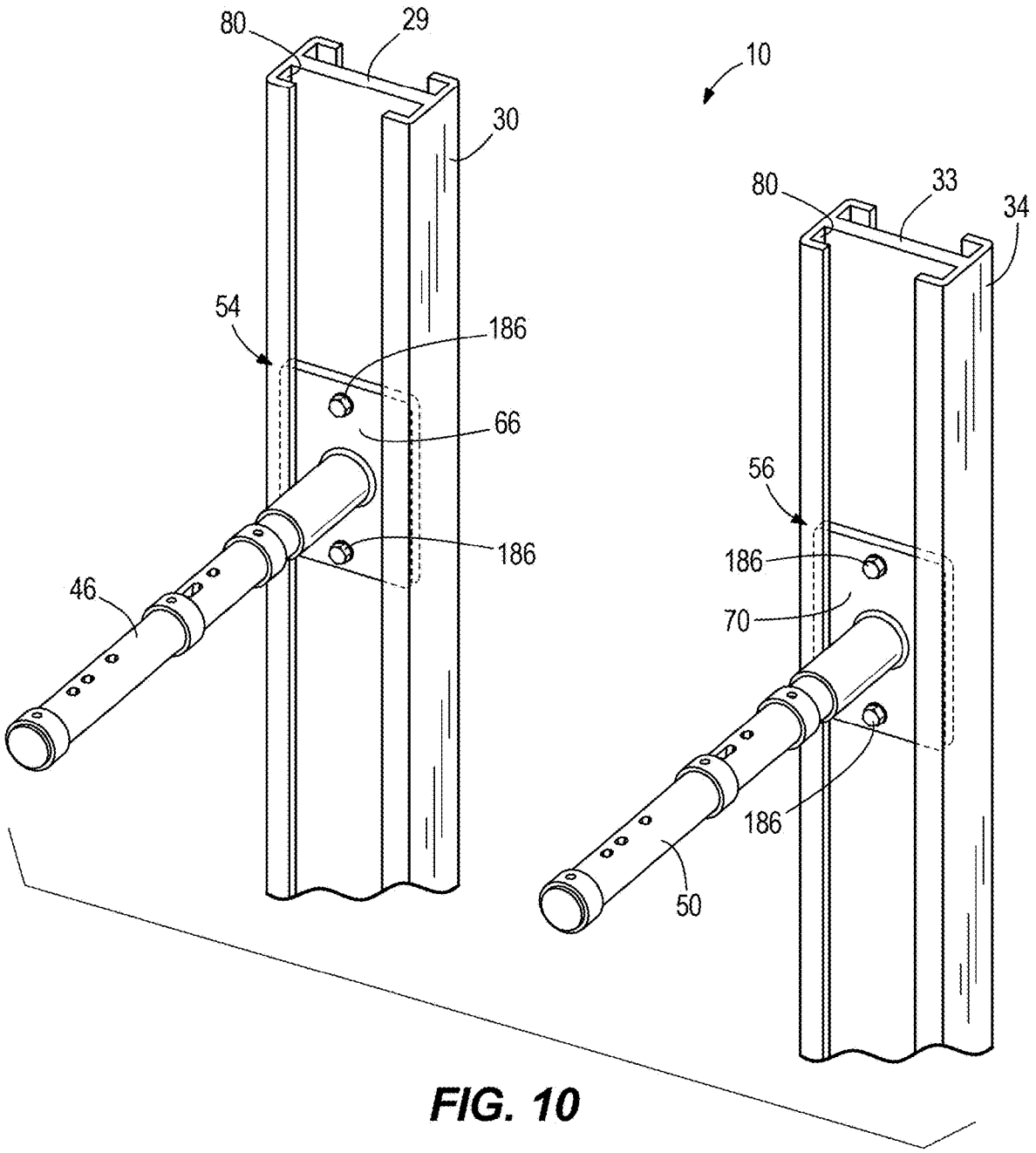
FIG. 10 is a front perspective view of an alternative upright in connection with the plate for use with the fixture carrier of FIG. 1.

In further alternative embodiments, as illustrated in FIG. 10, the brackets 58, 62 are eliminated and the plates 66, 70 are positioned directly onto the uprights 30, 34. In such instances, the uprights 30, 34 may comprise extruded aluminum (e.g., 80/20 T-slot aluminum, etc.) and include an elongate channel 80 formed along the length of the upright 30, 34. The plates 66, 70 are secured to the uprights 30, 34 within the channel 80. Specifically, the user slides the plates 66, 70 along the channel 80 of the uprights 30, 34. Fasteners 186 are secured to the plates 66, 70 to couple the plates 66, 70, to the uprights 30, 34.

Figure 6B:
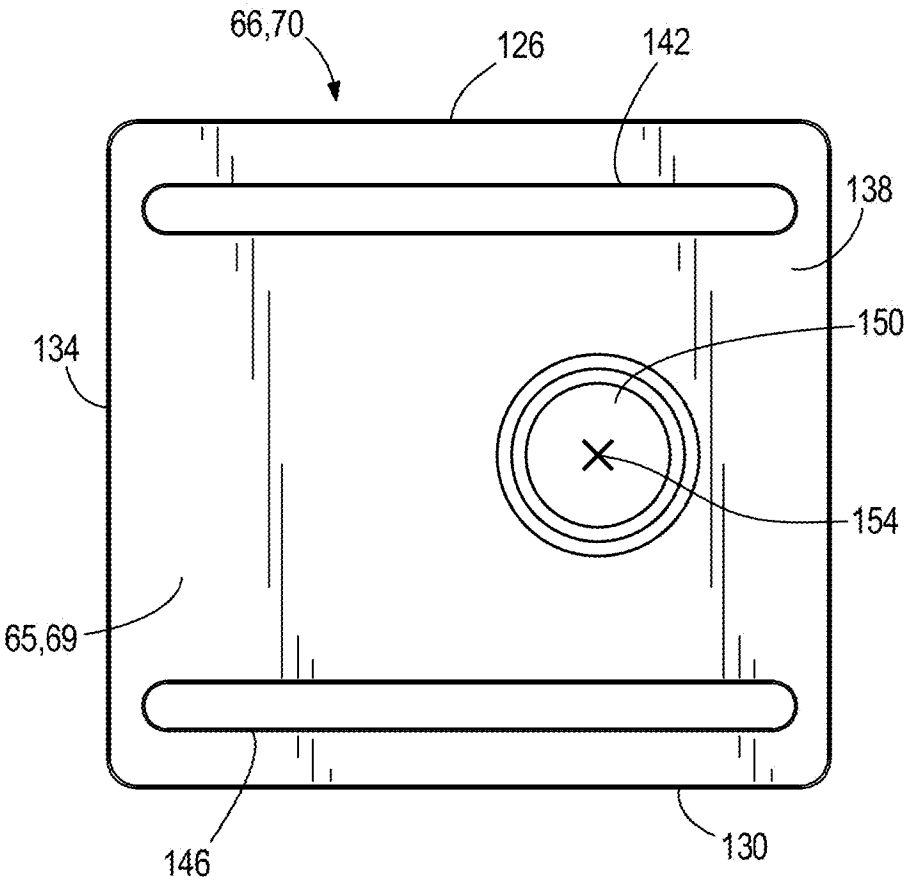
FIG. 6B is a front view of the plate of FIG. 6A.
Figure 6A:
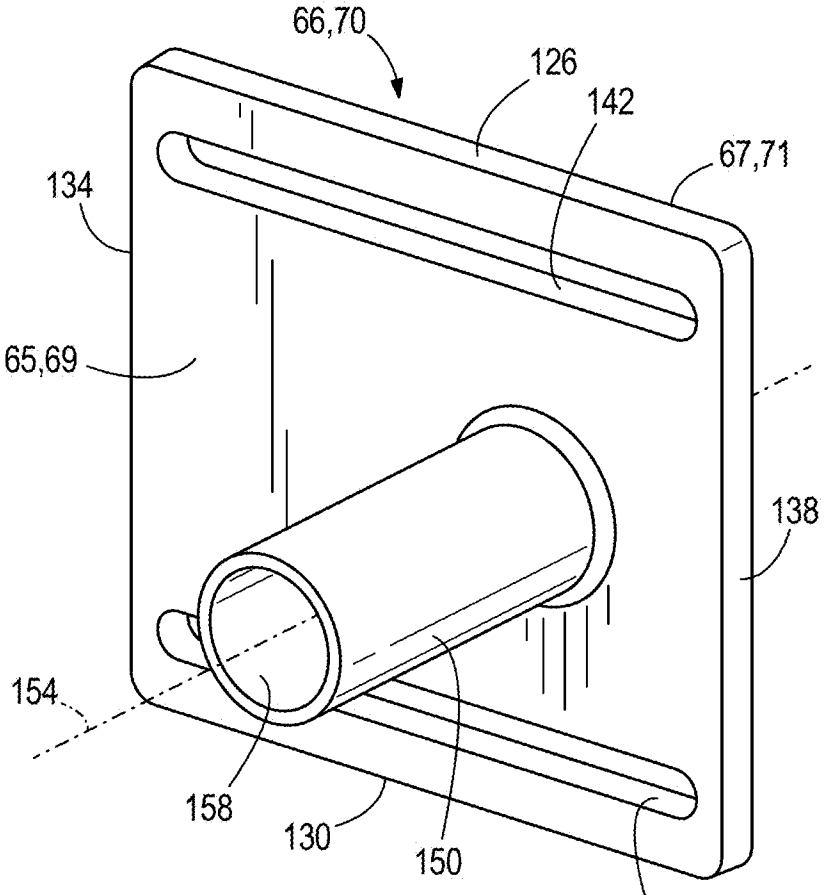
FIG. 6A is a perspective view of a plate of the fixture carrier of FIG. 1.

With reference to FIGS. 1-2, the first plate 66 is positioned between the first bracket 58 and the first arm 46. The second plate 70 is positioned between the second bracket 62 and the second arm 50. The plates 66, 70 are rectangular in shape. As illustrated in FIGS. 6A and 6B, the first plate 66 includes a first face 65 and a second face 67, and the second plate 70 includes a first face 69 and a second face 71. Additionally, each plate 66, 70 includes a top edge 126, a bottom edge 130, a first side edge 134, and a second side edge 138. The top edge 126 and the bottom edge 130 are substantially parallel to each other. The side edges 134, 138 are also parallel to each other and are perpendicular to the top and bottom edges 126, 130. The edges 126, 130, 134, 138 define a thickness of the plates 66, 70 between the first faces and second faces.

The plates 66, 70 additionally include a first elongated slot 142 and a second elongated slot 146 extending through the thickness of the plate. The first slot 142 is positioned near the top edge 126 of the plate. The first slot 142 is parallel to the top and bottom edges 126, 130. Similarly, the second slot 146 is positioned near the bottom edge 130 of the plate. The second slot 146 is parallel to the top and bottom edges 126, 130 and to the first slot 142. The first and second slots 142, 146 are shaped and sized to receive the studs 118 of the bracket 58, 62. The first slot 142 receives one stud 118 from the first flange 110 and one stud 118 from the second flange 114. Similarly, the second slot 146 receives one stud 118 from the first flange 110 and one stud 118 from the second flange 114. During installation of the plates 66, 70 onto the brackets 58, 62, a user may position the second faces 67, 71 of the plates 66, 70 against the flanges 110, 114 of the brackets 58, 62, thereby allowing the studs 118 to protrude through the first and second slots 142, 146. In order to move the plates 66, 70 to the desired position, the user may slide the plates 66, 70 in the horizontal direction. As the plates 66, 70 slide, the studs 118 slide along the first and second slots 142, 146. The user may secure the position of the plates 66, 70 relative to the brackets 58, 62 by securing a fastener to the studs 118.

With continued reference to FIGS. 6A and 6B, each plate 66, 70 includes a receptacle 150 extending from the front faces 65, 69 of the plates 66, 70. As illustrated, the receptacle has a circular cross-section, however other cross-sections may also be implemented. The receptacle 150 is eccentrically positioned on the plates 66, 70 such that an axis 154 of the receptacle 150 is equidistantly spaced between the top edge 126 and the bottom edge 130, and substantially closer to the first edge 134 than the second edge 138. In other words, the receptacle 150 is positioned off-center relative to the perimeter of the plate 66, 70. The axis 154 of the receptacle is positioned a first distance D1 (FIG. 3) relative to the Y-axis 22. When the plate moves along the slots, the distance D1 changes. Specifically, as the plates 66, 70 move toward the Y-axis 22, the distance D1 decreases, and as the plates 66, 70 move away from the Y-axis 22, the distance D1 increases. The plates 66, 70 are independently movable relative to each other. Furthermore, movement of the plates 66, 70 changes a second distance D2, which is defined as the distance between the axes 154 of the receptacles 150 of the first plate 66 and the second plate 70. The second distance D2 defines the width of the frame 14. As such, movement of one or both of the plates 66, 70 modifies the width of the frame 14.

Each of the plates 66, 70 may be secured to each of the brackets 58, 62, in a first position or in a second position. For example, as illustrated in FIG. 3, the plates 66, 70 are secured to the brackets 58, 62 in the first position where the second side edges 138 are positioned closer to the Y-axis 22 than the first side edges 134. In other words, the first side edges 134 of the plates 66, 70 are positioned outside of the first and second uprights 30, 34. As another example, if the plates 66, 70 are rotated 180 degrees from their positions shown in FIG. 3, the plates 66, 70 are in the second position. In the second position, the plates 66, 70 are secured to the brackets 58, 62 such that the first side edges 134 of the plates 66, 70 are closer to the Y-axis 22 than the second side edges 138. More specifically, the second side edges 138 of the plates 66, 70 are positioned outside of the first and second uprights 30, 34. In order to reposition the plates 66, 70 from the first position to the second position, the user removes the plate 66, 70 from the bracket 58, 62 and rotates the plate 180 degrees about the Z-axis 26. The user then repositions the first and second slots 142, 146 with the corresponding studs 118 of the bracket 58, 62, abuts the plate 66, 70 against the bracket 58, 62 in a desired position, and secures fasteners to the studs 118. In a further example, the first plate 66 may be secured to the first bracket 58 in the first position while the second plate 70 is secured to the second bracket 62 in the second position, and vice versa. In alternative embodiments, toggle clamps may be used to secure the plates 66, 70 to the brackets 58, 62 and/or directly to the uprights 30, 34.

As mentioned above, the plates 66, 70 are independently, axially movable in the horizontal direction (i.e., in the X direction) in order to selectively adjust the width of the frame 14. The eccentric positioning of the receptacles 150, in conjunction with the slots 142, 146, allows for greater variation in the second distance D2 between the receptacles' axes 154, and therefore greater variation in the width of the frame 14. The user may selectively position the first and/or second plates 66, 70 in the first position if a wider distance between the plates 66, 70 is needed for a plumbing fixture installation. Alternatively, the user may position the first and/or second plates 66, 70 in the second position if a narrower distance between the plates 66, 70 is needed during a plumbing fixture installation. The horizontal range between the axes 154 is 13" to 21".

The receptacles 150 additionally include an inner surface 158 having threads. Specifically, each of the receptacles 150 are sized to receive and secure the arms 46, 50 to the plates 66, 70. During installation of the fixture carrier 10, the arms 46, 50 may be secured to the receptacles 150 such that the arms 46, 50 are axially movable with the plates 66, 70 in the horizontal direction.

Figure 11:
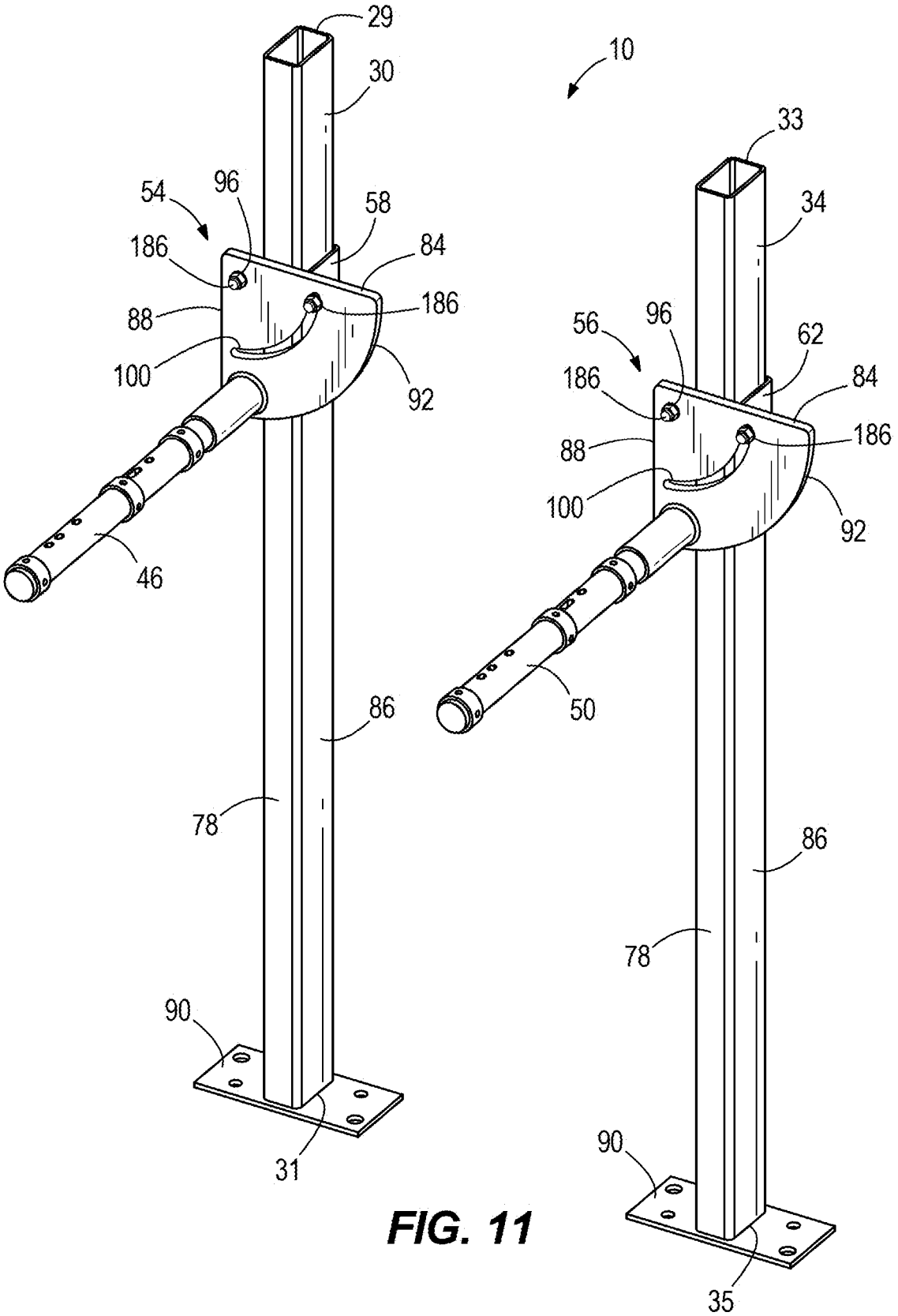
FIG. 11 is a front perspective view of an alternative plate in connection with the upright for use with the fixture carrier of FIG. 1.

Alternatively, as illustrated in FIG. 11, the plates 66, 70 may be wedge-shaped (e.g., a quarter of a cylinder). In such instances, each plate 66, 70 includes a first edge 84, a second edge 88 oriented perpendicular relative to the first edge 84, and a curved edge 92 connected to the first edge 84 and the second edge 88. The plates 66, 70 additionally include an aperture 96 and an elongate slot 100. The aperture 96 is positioned adjacent the first edge 84 and the second edge 88. The aperture 96 is shaped and sized to receive the stud 118 from the first flange 110 of the bracket 58, 62. The elongate slot 100 is C-shaped and extends across the plate 66, 70. The elongate slot 100 is shaped and sized to receive the studs 118 of the second flange 114 of the bracket 58, 62. During installation of each plate 66, 70 onto the bracket 58, 62, the user positions the plate 66, 70 onto the bracket 58, 62, thereby allowing the studs 118 to protrude through the aperture 96 and the elongate slot 100. In order to move the plate 66, 70 to the desired position, the user slides (e.g., pivots) the plate 66, 70, such that the stud 118 slides along the elongate slot 100. Movement of the plate 66, 70 along the elongate slot 100 repositions the plate 66, 70 in the horizontal and vertical direction. The user may secure the position of the plate 66, 70 relative to the brackets 58, 62 by securing fasteners 186 to the studs 118.

Figure 12:
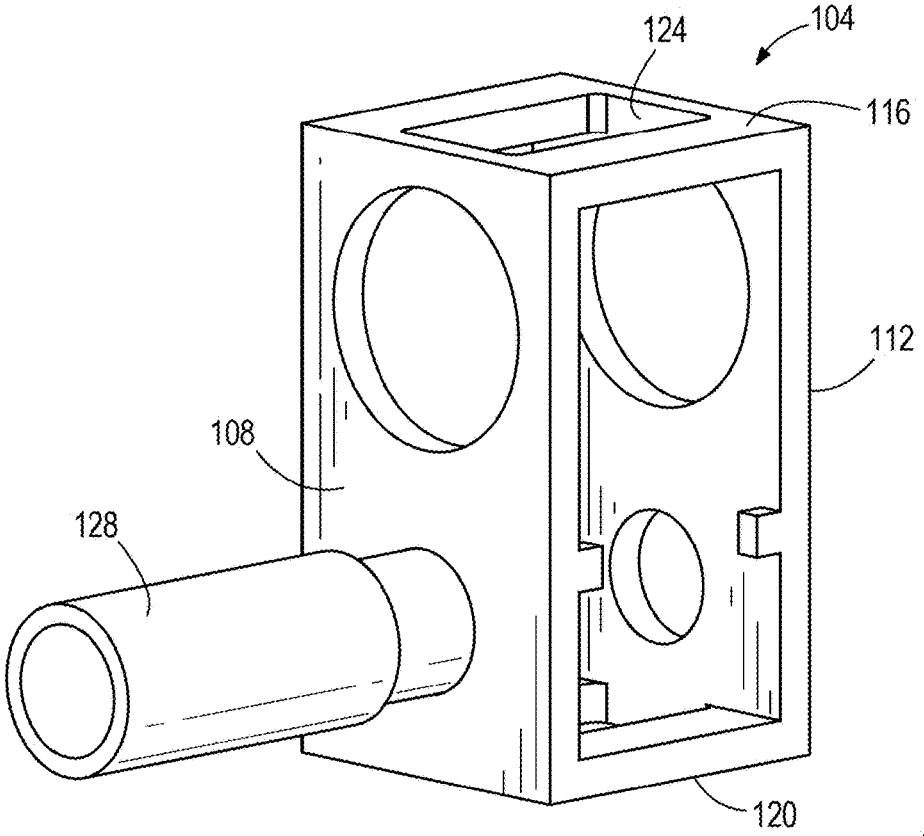
FIG. 12 is a front perspective view of an alternative coupling mechanism for use with the fixture carrier of FIG. 1.

As illustrated in FIG. 12, the coupling mechanism 54, 56 may alternatively include a support 104 to connect the arm 46, 50 to the upright 30, 34. Each support 104 is positioned around the upright 30, 34 and supports the arm 46, 50. Each support 104 includes a first face 108, a second face 112, a top face 116, and a bottom face 120. An aperture 124 extends through the top and bottom faces 116, 120. The aperture 124 is rectangular and is shaped and sized to receive the upright 30, 34. When positioning the support 104 on the upright 30, 34, the user may slide the support 104 along the longitudinal axis 74 to a desired position. Then the user may insert a fastener through the support 104 and into the upright 30, 34, thereby securing the position of the support 104. Additionally, the support 104 includes a receptacle 128 extending from the first face 108. The receptacle 128 is identical to the receptacle 150 of the plates 66, 70 and is shaped and sized to receive the arm 46, 50.

Figure 7:
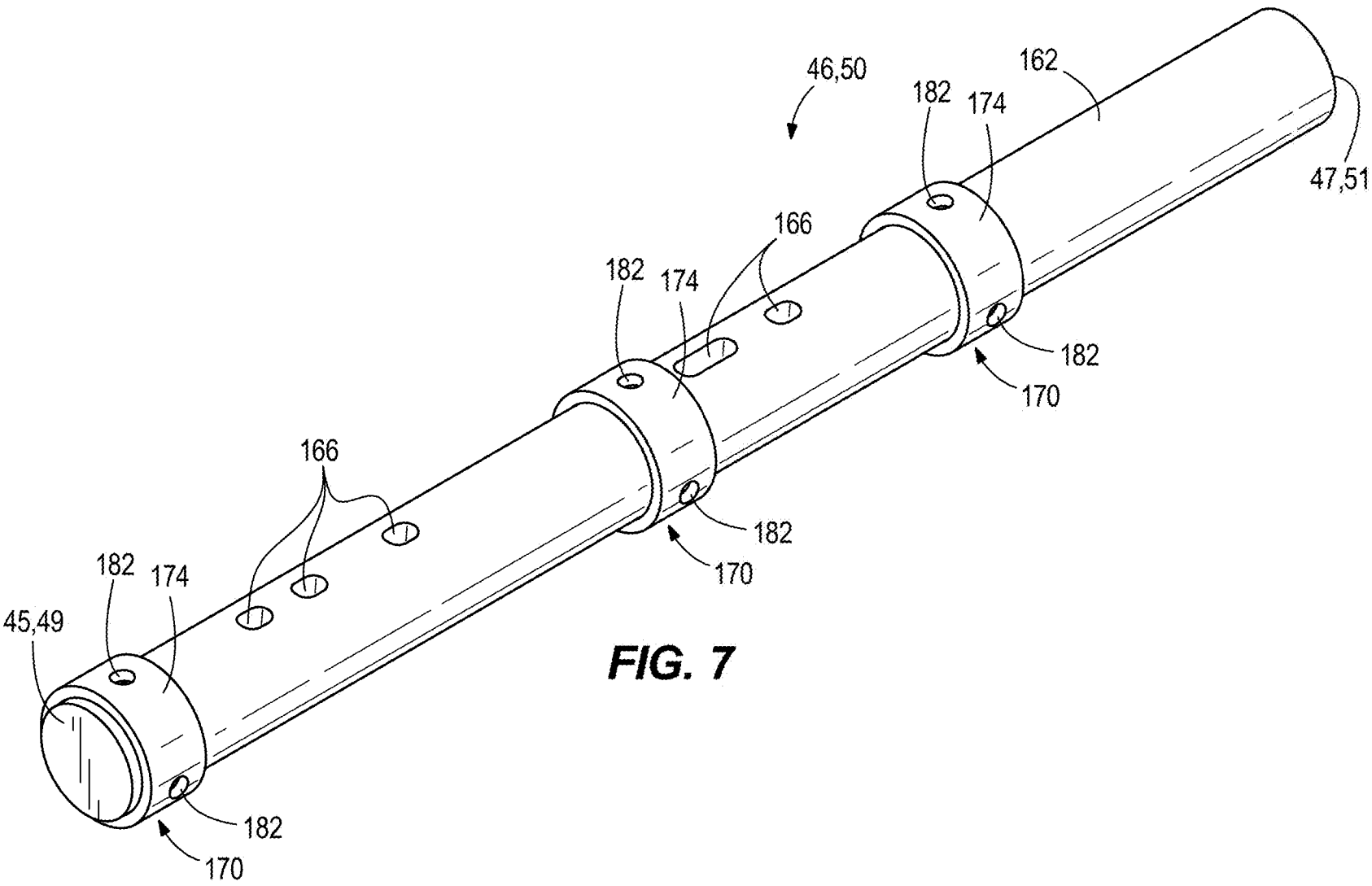
FIG. 7 is a front perspective view of an arm of the fixture carrier of FIG. 1.

The arms 46, 50 extend from the frame 14 to support a plumbing fixture during use. With reference to FIG. 7, the first and second arms 46, 50 include a body 162, elongated slots 166 extending into the body 162, and sleeves 170 positioned on the body 162. The body 162 is cylindrical in cross-section and includes a first end 45, 49, and a second end 47, 51 opposite the first ends 45, 49. The first ends 45, 49 of the arms 46, 50 extend outward from the frame 14 and the second ends 47, 51 of the arms 46, 50 are secured to the receptacles 150 of the plates 66, 70. The second ends 47, 51 of the arms 46, 50 include threads corresponding to the threads positioned on the inner surfaces 158 the receptacles 150. Therefore, each of the arms 46, 50 are threadably coupled to the receptacles 150. In alternative embodiments, the arms 46, 50 may be threaded along the length or partial length of the body 162. In alternative embodiments, the arm 46, 50 may be secured to the receptacle 150 via several fasteners (e.g., threaded fasteners). Specifically, the receptacle 150 includes various threaded apertures equidistantly spaced around the perimeter of the receptacle 150. After the arm 46, 50 is positioned within the receptacle 150, the fasteners are threaded into the apertures and into abutment with the arm 46, 50. The fasteners may be continually threaded until there is a snug connection between the fasteners and the arm 46, 50, thereby inhibiting the arm 46, 50 from moving.

In the illustrated embodiments, the slots 166 are cylindrical apertures which extend through the arm 46, 50. However, in alternative embodiments, the slots 166 may be elongated slots extending along the length of the body 162. In such instances, the body 162 may include one or several slots 166.

Each of the sleeves 170 are supported by the arms 46, 50 and are movable (e.g., slidable) along the arms 46, 50 in a direction parallel to the Z-axis 26. In some embodiments, the sleeves 170 may also or alternatively rotate relative to the arms 46, 50. Each of the sleeves 170 includes a body 174 having an outer surface configured to be engaged by the user to move the sleeve 170 relative to the arms 46, 50. In the illustrated embodiments, each of the sleeves 170 are secured to the arms via pins or set screws. As illustrated, the arms 46, 50 include three sleeves 170. However, in alternative embodiments, the arms 46, 50 may include fewer or more sleeves. Each of the sleeves 170 includes a circular aperture 182 extending through the sleeve 170. The sleeve apertures 182 and the slots 166 of the body 162 are shaped and sized to receive the pin or set screw. The pin extends through the sleeve aperture 182 and the slot 166 to secure the sleeve 170 in a specific position on the arms 46, 50.

The pins are slidable along the length of the slot 166, such that movement of the pin axially repositions the sleeve 170 relative to the body 162. Specifically, a user may slide the pin to a position such that it aligns with a corresponding aperture on a plumbing fixture. A user may secure the pin and the sleeve 170 in a desired position via a fastener (e.g., a screw and/or a lock down). The pin may then protrude through the corresponding aperture on the plumbing fixture and support the fixture during use. As such, the sleeves 170 and pins may be repositioned in a direction parallel to the Z-axis 26 to align with plumbing fixtures of various lengths.

In alternative embodiments, the pin may be a cotter pin, or alternative type of fastener. In still further embodiments, the pin may be a bolt. In such instances, the bolt may be tightened to secure the arm 46, 50 to the sleeve 170 and/or to secure the arm 46, 50 to the receptacle 150. In still further embodiments, the pin may be a spring-loaded actuator. In such instances, the actuator is positioned within the slot 166 on the arm 46, 50. A spring biases the actuator upwards through the slot 166 and the sleeve aperture 182, thereby preventing movement of the sleeve 170 relative to the arm 46, 50.

Figure 13:
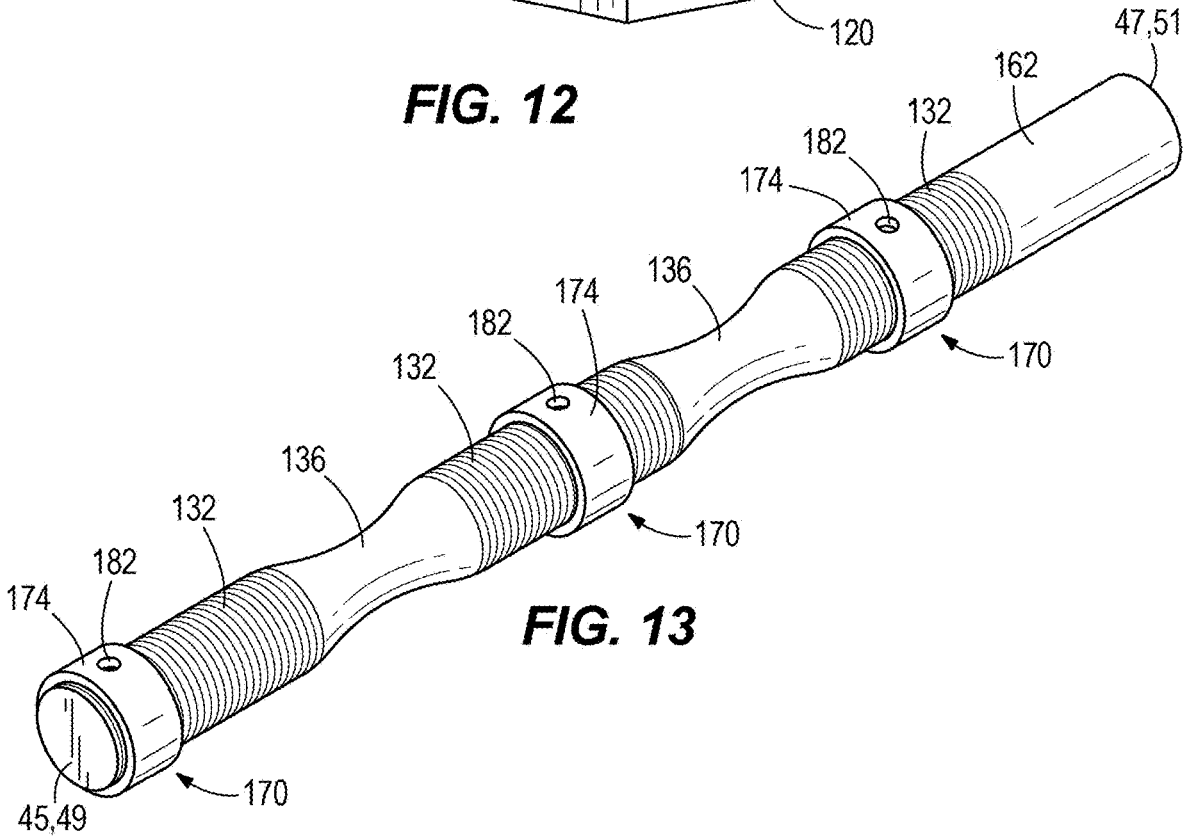
FIG. 13 is a front perspective view of an alternative arm for use with the fixture carrier of FIG. 1.

FIG. 13 illustrates an alternative embodiment in which the body 162 of each arm 46, 50 includes threaded portions 132 and reduced diameter portions 136. In the illustrated embodiments, each of the sleeves 170 are movable along the arms 46, 50 in a direction parallel to the Z-axis. More specifically, the sleeves 170 includes female threads corresponding to the threaded portions 132 on the body 162 of the arms 46, 50. The sleeves 170 may move along the arms 46, 50 by rotating the sleeves 170 relative to the body 162 in the clockwise and/or counterclockwise direction. In the illustrated embodiments, each arm 46, 50 includes three threaded portions 132 and three sleeves 170. However, the arms 46, 50 may include fewer or more threaded portions 132 and/or sleeves 170.

With continued reference to FIG. 13, each arm 46, 50 additionally includes two reduced diameter portions 136. More specifically, the reduced diameter portions 136 are positioned between the threaded portions 132 and include a reduced diameter compared to the remainder of the arm 46, 50. The reduced diameter portions 136 remove localized regions of high stress and discontinuities, thereby increasing the durability of the arm 46, 50 to extend the operational lifetime of the arm 46, 50. In some embodiments, the arms 46, 50 may include fewer or more reduced diameter portions 136.

Figure 14:
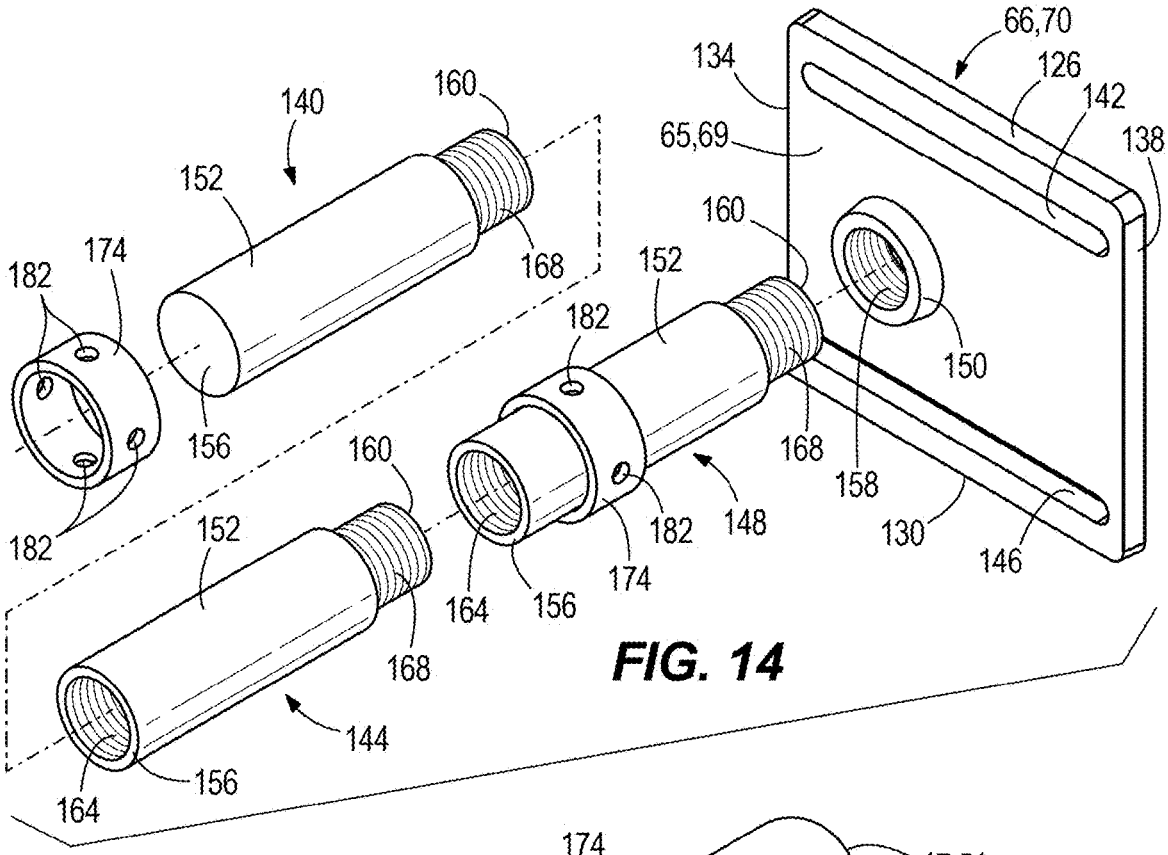
FIG. 14 is a front perspective view of another alternative arm in connection with the plate for use with the fixture carrier of FIG. 1.

FIG. 14 illustrates another alternative embodiment in which each of the arms 46, 50 include a first segment 140, a second segment 144, and a third segment 148. Each of the segments 140, 144, 148 include a body 152, which is cylindrical in cross-section, and includes a first end 156 and a second end 160 opposite the first end 156. The first end 156 of the first segment 140 is closed, while the first end 156 of the second and third segments 144, 148 are open and include female threads 164. Additionally, the second end 160 of the segments 140, 144, 148 include male threads 168 corresponding to the female threads 164 on the first end 156 of the segments 144, 148. During installation of the arms 46, 50, each of the segments 140, 144, 148 may be threadably coupled to each other. More specifically, the second end 160 of the first segment 140 may be threadably coupled to the first end 156 of the second segment 144, the second end 160 of the second segment 144 may be threadably coupled to the first end 156 of the third segment 148, and the second end 156 of the third segment 148 may be threadably coupled to the inner surface 158 of the receptacle 150. The user may selectively add or remove segments 140, 144, 148 to the arms 46, 50 in order to lengthen or shorten the length of the arms 46, 50. Therefore, the arms 46, 50 may be modified to accommodate plumbing structures (e.g., lavatories) of various lengths.

Figure 15A:
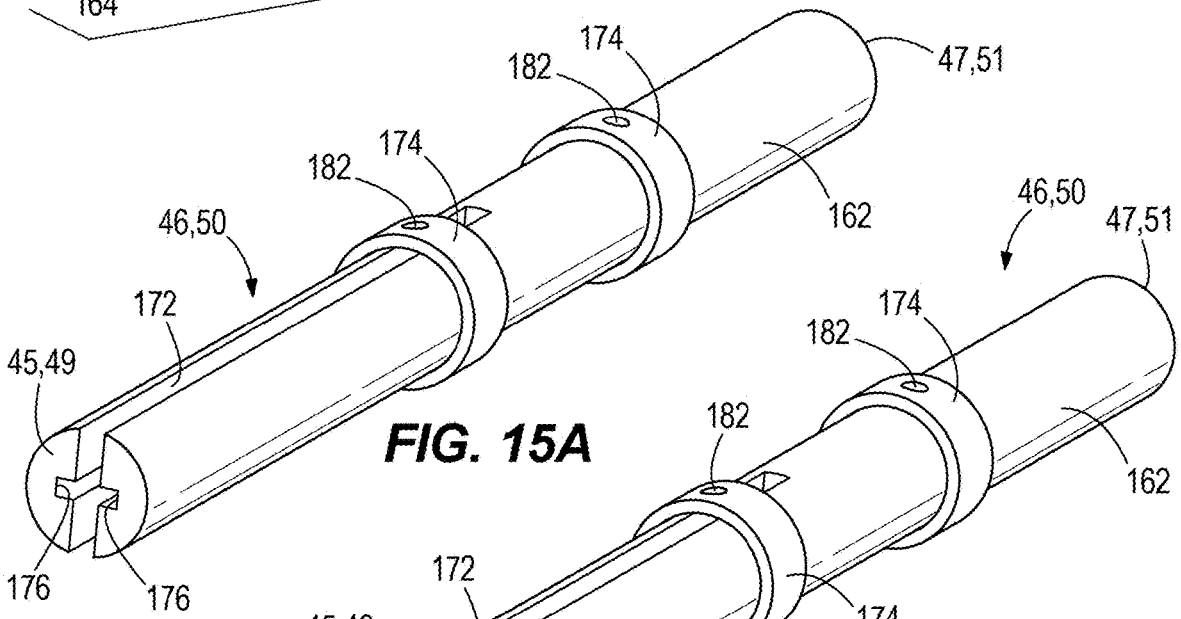
FIGS. 15A-15B are front perspective views of another alternative arms for use with the fixture carrier of FIG. 1.
Figure 15B:
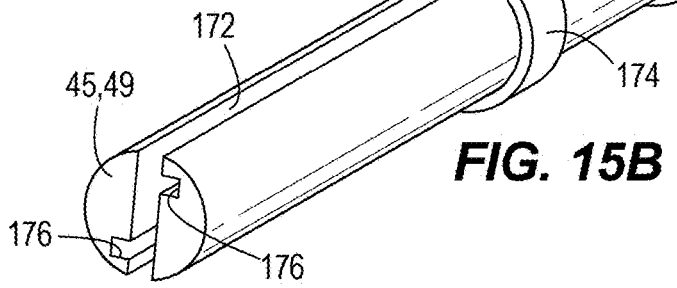

FIGS. 15A-15B illustrate an alternative embodiment in which each arm 46, 50 includes a slot 172 extending through the body 162. Specifically, the slot 172 may extend from a center of the first end 45, 59 of the arm 46, 50, and through a portion of the body 162. In the illustrated embodiments, the slot 172 includes various branches 176. For example, with reference to FIG. 15A, the slot 172 includes two branches 176 forming a T-shaped (e.g., FIG. 15A) slot. Alternatively, with reference to FIG. 15B, the slot 172 includes two branches 176 forming a Z-shaped slot. However, in alternative embodiments, the slot 172 may include different shapes. The slot 172 is shaped to receive a keyed pin or fastener. Specifically, the user inserts the keyed pin through the aperture 182 of the sleeve 170 and the elongate slot 172. The user rotates the keyed pin, thereby enabling keyed portions of the keyed pin to engage the branches 176 of the slot 172 and preventing movement of the keyed pin in the vertical direction.

The fixture carrier 10 is used to support a plumbing fixture being installed in a structure. The fixture carrier 10 may be adjusted to support different fixtures of various sizes. The position of the coupling mechanisms 54 may be adjusted relative to the uprights 30, 34 in order to accommodate fixtures of different heights. Specifically, the user may slide each of the brackets 58, 62 along the longitudinal axis 74 of the uprights 30, 34 and insert fasteners into the bracket aperture 122, thereby securing the position of the brackets 58, 62. The width of the frame 14 (e.g., the position of the arms along the X-axis 18) may be adjusted via movement of the plates 66, 70. Specifically, the user may position each of the plates 66, 70 on the bracket 58, 62 such that the studs 118 protrude through the slots 142, 146 of the plate 66, 70, slide each of the plates 66, 70 in a direction substantially parallel to the X-axis 18, and place fasteners onto the studs 118, thereby securing the position of the plates 66, 70 relative to bracket 58, 62. Finally, the position of the sleeves 170 may be adjusted relative to the arms 46, 50 in order to accommodate fixtures of various depths. Specifically, the user may slide each of the sleeves 170 along the arm 46, 50 and align the sleeve aperture 182 with the slots 166 of the body 162. The user may then insert the pin through the aperture 182 and the slot 166, and secure the positioning of the pin by inserting a fastener. The plumbing fixture may be the placed on the frame 14 for support.

FIGS. 16-23 illustrate alternative fixture carriers. The illustrated fixture carriers are similar to the fixture carrier 10 described above and includes like parts. Reference is hereby made to the description of the fixture carrier 10 shown in FIGS. 1-7 for description of features and elements of the fixture carriers not specifically included below.

Figure 16:
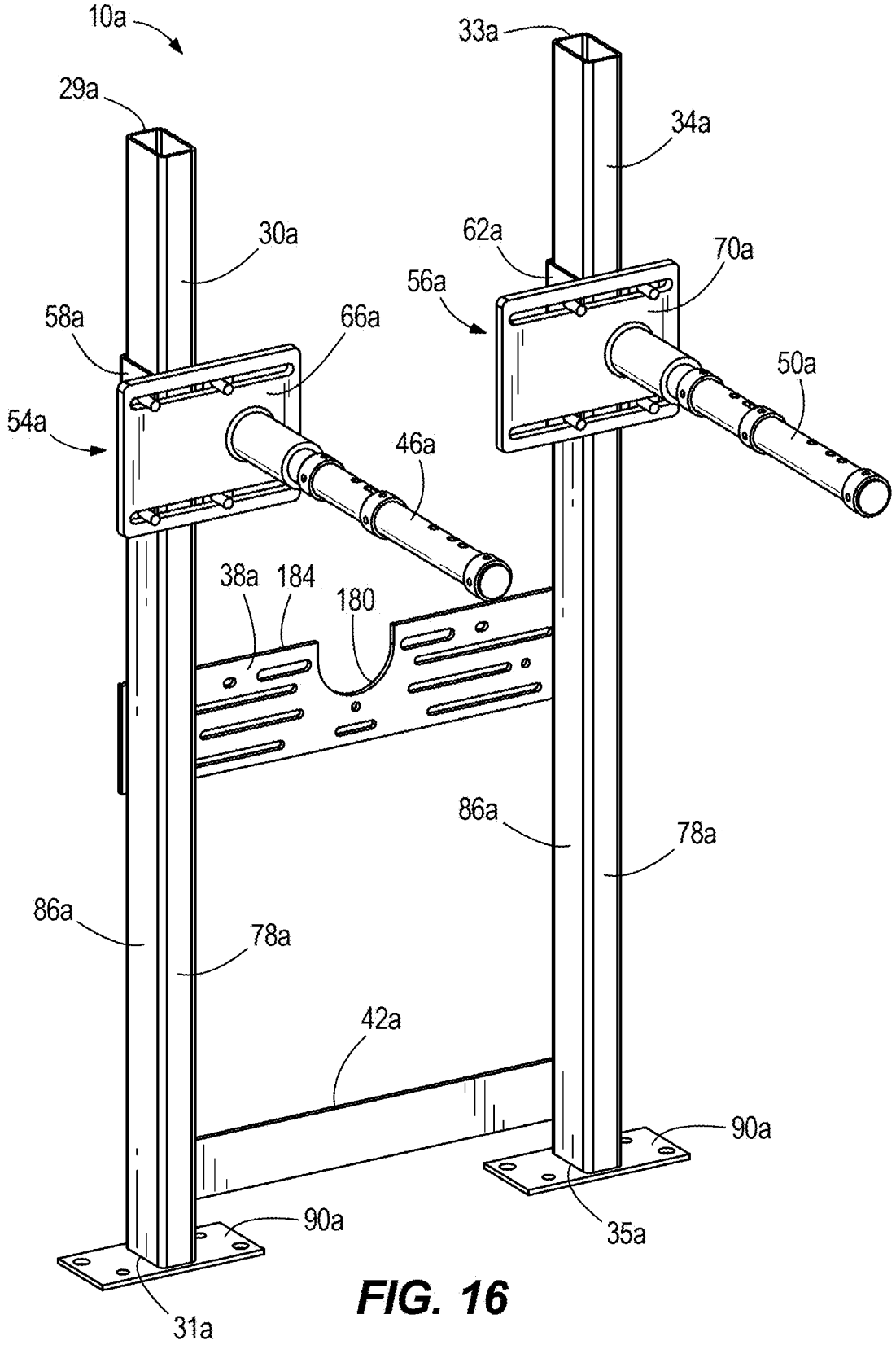
FIG. 16 is a front perspective view of another fixture carrier according to an embodiment of the present disclosure.
Figure 17:
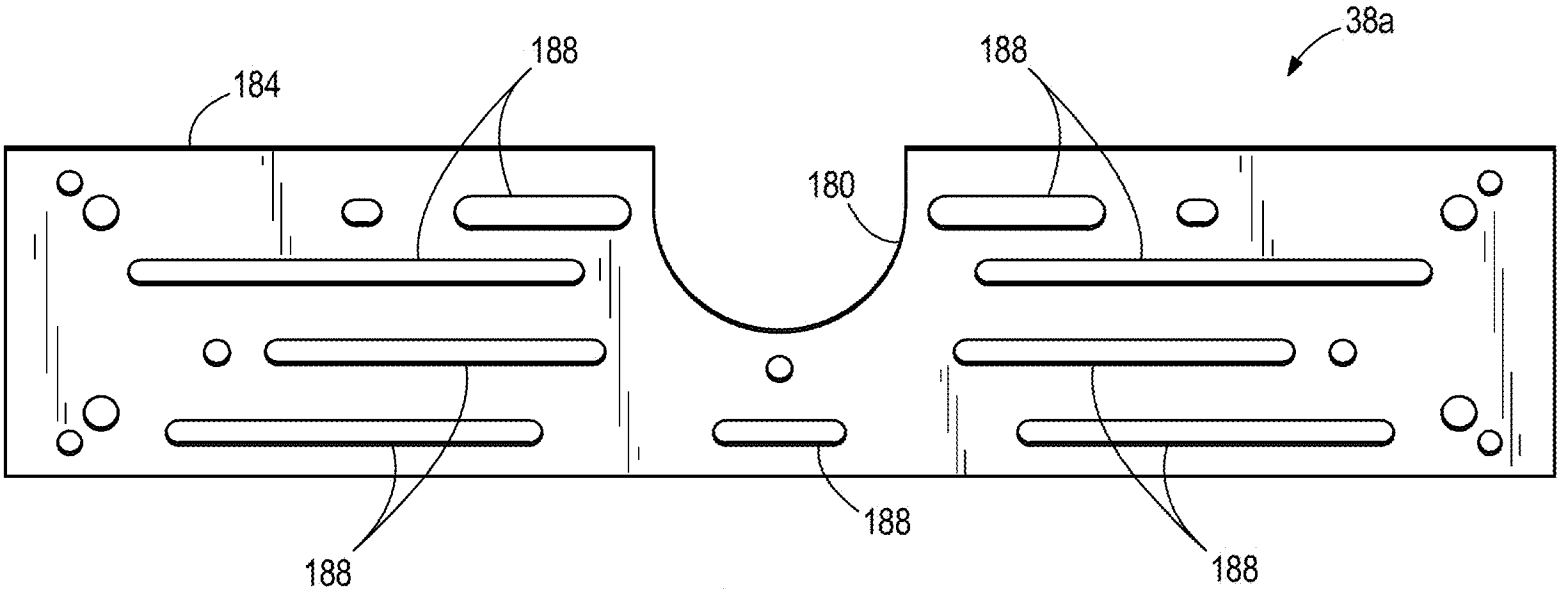
FIG. 17 is a front view of a cross-bar of the fixture carrier of FIG. 16.

FIGS. 16-17 illustrate another embodiment of a fixture carrier 10*a*, with like components designated with an "a". The fixture carrier 10*a* itself is largely identical to the fixture carrier 10, while the first cross-bar 38*a* has changed, as described below.

With reference to FIG. 17, the first cross-bar 38*a* is rectangular and planar. The cross-bar 38*a* additionally includes a semi-circular recess 180 extending through an upper edge 184 of the cross-bar 38*a*. The semi-circular recess 180 is shaped and sized to receive a pipe or fitting of a plumbing fixture during installation of the plumbing fixture. The cross-bar 38*a* additionally includes various slots 188 extending through the cross-bar 38*a*. The slots 188 allow for pipes and/or fittings (e.g., drain lines, waste lines, potable water lines, potable supply lines, etc.) to be secured during installation process. More specifically, the slots 188 provide an attachment for threaded rods, welded steel rods, etc. during the installation process.

Figure 18:
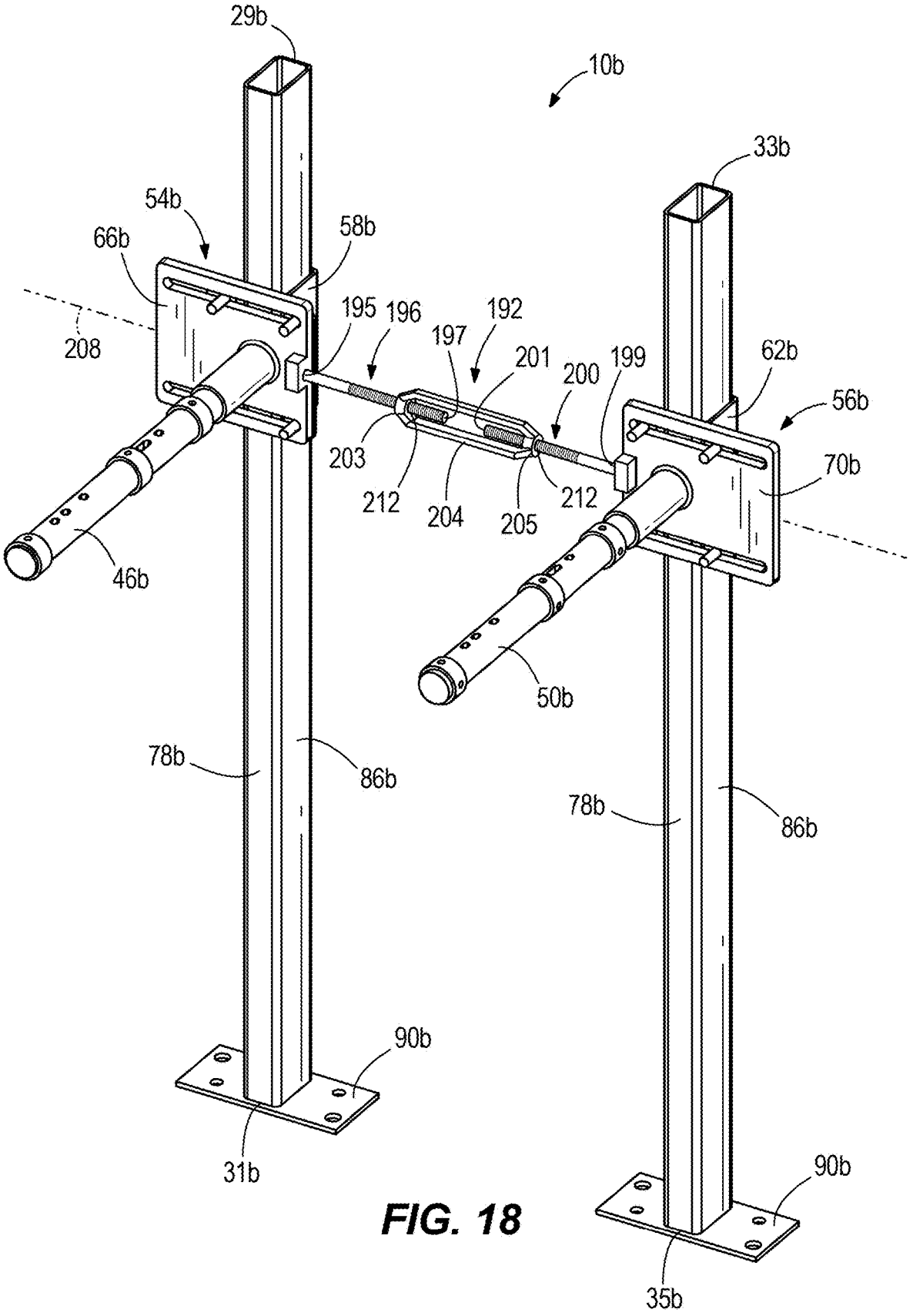
FIG. 18 is a front perspective view of another fixture carrier according to an embodiment of the present disclosure.

FIG. 18 illustrates another embodiment of a fixture carrier 10*b*, with like components designated with a "b". The fixture carrier 10*b* itself is largely identical to the fixture carrier 10, while the cross-bars 38, 42 have been replaced by an adjustment mechanism 192, as described below.

The adjustment mechanism 192 is coupled to the frame 14*b* and includes a first rod 196, a second rod 200, and a turnbuckle 204. Each of the rods 196, 200 are substantially cylindrical. The first rod 196 extends between and is coupled to the first upright 30*b* and the turnbuckle 204. The first rod 196 includes a first end 195 coupled to the first upright 30*b*, and a second end 197 which is substantially threaded and is coupled to the turnbuckle 204. More specifically, the second end 197 of the first rod 196 is threadably coupled to a first end 203 of the turnbuckle 204. The second rod 200 extends between and is coupled to the second upright 34*b* and the turnbuckle 204. The second rod 200 includes a first end 199 coupled to the second upright 34*b*, and a second end 201 which is substantially threaded and coupled to the turnbuckle 204. More specifically, the second end 201 of the second rod 200 is threadably coupled to a second end 205 of the turnbuckle 204. Each of the rods 196, 200 includes a horizontal axis 208 extending through the first ends 195, 199 and the second ends 197, 201. With continued reference to FIG. 18, the horizontal axis 208 of the first and second rods 196, 200 is substantially parallel to the X-axis 18*b*, and perpendicular relative to the Y-axis 22*b* and the Z-axis 26*b*.

With continued reference to FIG. 18, the turnbuckle 204 is positioned between the first rod 196 and the second rod 200 and extends along the horizontal axis 208. As described above, the turnbuckle 204 includes the first end 203, which is coupled to the second end 197 of the first rod 196, and the second end 205 opposite the first end 203, which is coupled to the second end 201 of the second rod 200. The first and second ends 203, 205 of the turnbuckle 204 each include a circular aperture 212. The apertures 212 are substantially threaded such that the second ends 197, 201 of the first and second rods 196, 200 may threadably received within the apertures 212.

During operation of the fixture carrier 10*b*, a user rotates the turnbuckle 204 in a first direction (e.g., a clockwise direction), and/or a second direction (e.g., a counterclockwise direction). When the turnbuckle 204 is rotated in the first direction, the first rod 196 is rotated into the turnbuckle 204 and axially moves along the horizontal axis 208. Similarly, when the turnbuckle 204 is rotated in the first direction, the second rod 200 is rotated into the turnbuckle 204 and axially moves along the horizontal axis 208. As such, when the turnbuckle 204 is rotated in the first direction, the distance between the second ends 197, 201 of the rods 196, 200, and the distance between the uprights 30*b*, 34*b*, is decreased. Alternatively, when the turnbuckle 200 is rotated in the second direction, the first rod 196 is rotated out of the turnbuckle 204 and axially moves along the horizontal axis 208. Similarly, when the turnbuckle 204 is rotated in the second direction, the second rod 200 is rotated out of the turnbuckle 204 and axially moves along the horizontal axis 208. As such, when the turnbuckle 204 is rotated in the second direction, the distance between the second ends 197, 201 of the rods 196, 200, and the distance between the uprights 30*b*, 34*b*, is increased. Therefore, the width of the frame 14*b* may be adjusted via rotation of the turnbuckle 204.

Figure 19:
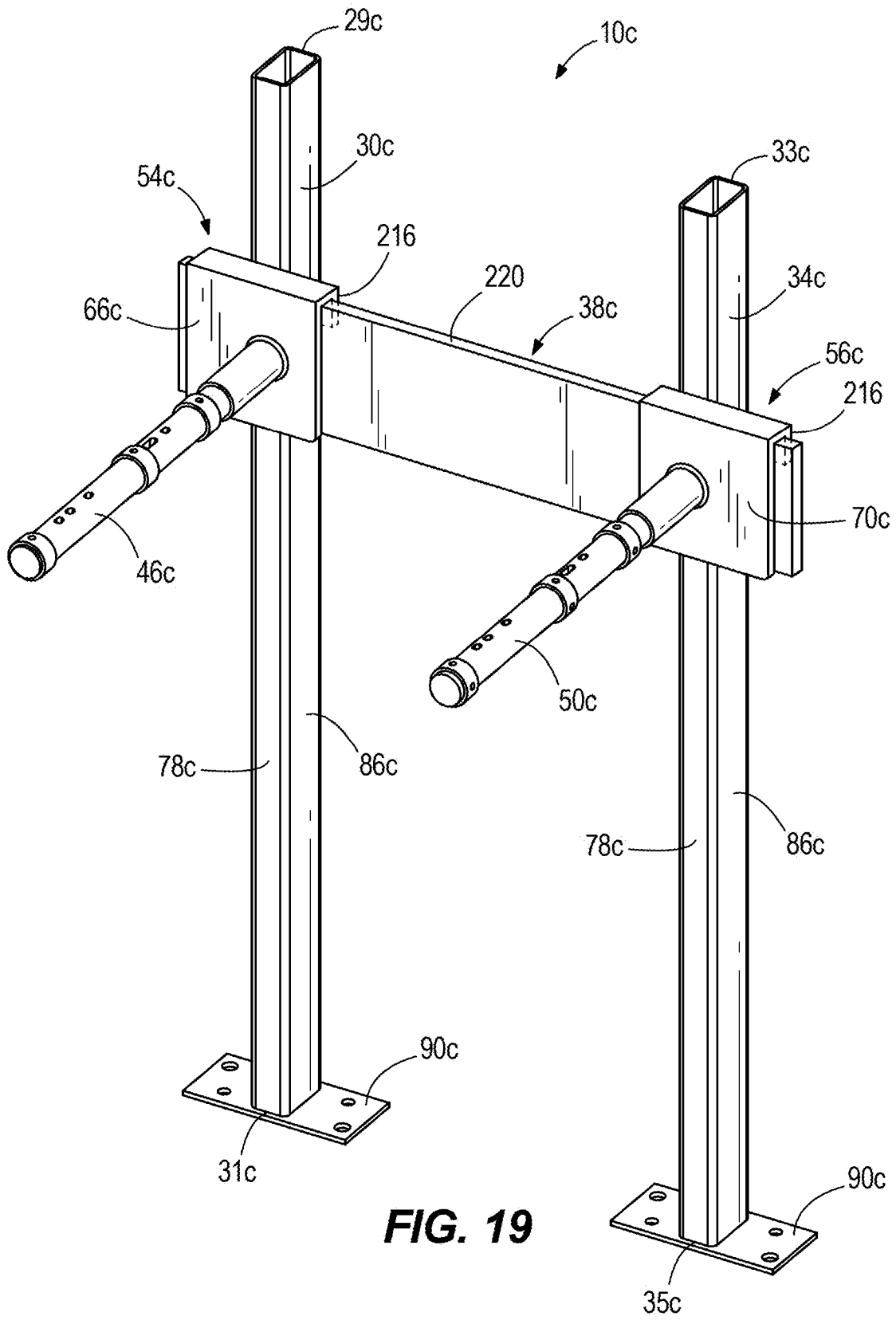
FIG. 19 is a front perspective view of another fixture carrier according to an embodiment of the present disclosure.

FIG. 19 illustrates another embodiment of a fixture carrier 10*c*, with like components designated with a "c". The fixture carrier 10*c* itself is mostly identical to the fixture carrier 10, while the first cross-bar 38 and the plates 66, 70 have been modified, as described below.

With continued reference to FIG. 19, the first cross-bar 38*c* is rectangular and planar. The first end 37*c* of the first cross-bar 38*c* is coupled to the front face 78*c* of the first upright 30*c* and the second end 39*c* of the first cross-bar 38*c* is coupled to the front face 78*c* of the second upright 34*c*. In the illustrated embodiments, the first cross-bar 38*c* is permanently coupled to the uprights 30*c*, 34*c*. However, in alternative embodiments, the first cross-bar 38*c* may be removably coupled to the uprights 30*c*, 34*c*. In the illustrated embodiments, the frame 14*c* includes a single cross-bar 38*c*. However, in alternative embodiments, the frame 14*c* may include a second cross-bar 42*c*.

With continued reference to FIG. 19, the first plate 66*c* is positioned between the first cross-bar 38*c* and the first arm 46*c*. The second plate 70*c* is positioned between the first cross-bar 38*c* and the second arm 50*c*. The plates 66*c*, 70*c* are rectangular in shape. As illustrated in FIG. 19, each plate includes an L-shaped flange 216 extending from and substantially perpendicular to the top edge 126*c*. The flange 216 is configured to engage a top edge 220 of the first-cross-bar 38*c*, thereby removably securing the plates 66*c*, 70*c* to the first cross-bar 38*c*.

The user may slide the plates 66*c*, 70*c* along the top edge 220 of the first cross-bar 38*c*. More specifically, the user may independently move (e.g., slide) the plates 66*c*, 70*c* relative to each other. For example, the user may slide the first plate 66*c* along the first cross-bar 38*c* in a direction toward the first end 37*c* of the first cross-bar 38*c*, or toward the second end 39*c* of the first cross-bar 38*c*. Similarly, the user may slide the second plate 70*c* along the first cross-bar 38*c* in a direction toward the first end 37*c* of the first cross-bar 38*c*, or toward the second end 39*c* of the first cross-bar 38*c*. As such, the user may selectively increase and/or decrease the distance between the plates 66*c*, 70*c*, and the distance between the arms 46*c*, 50*c*. Therefore, the width of the frame 14*c* may be adjusted via movement of the plates 66*c*, 70*c* along the first cross-bar 38*c*. Alternatively, the user may remove either the first plate 66*c* and/or the second plate 70*c* from the frame 14*c*.

Figure 20A:
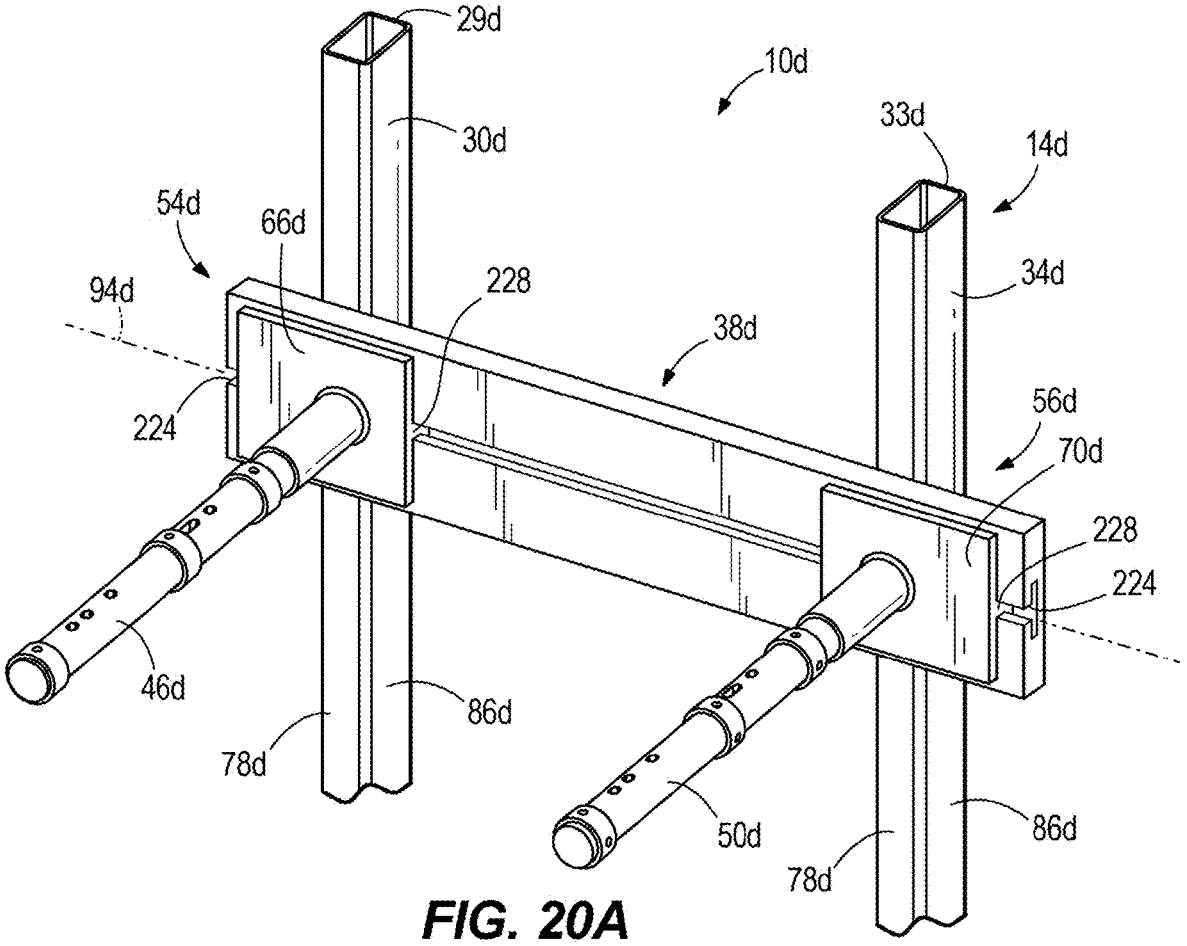
FIG. 20A-20B are front perspective views of another fixture carrier according to an embodiment of the present disclosure.
Figure 20B:
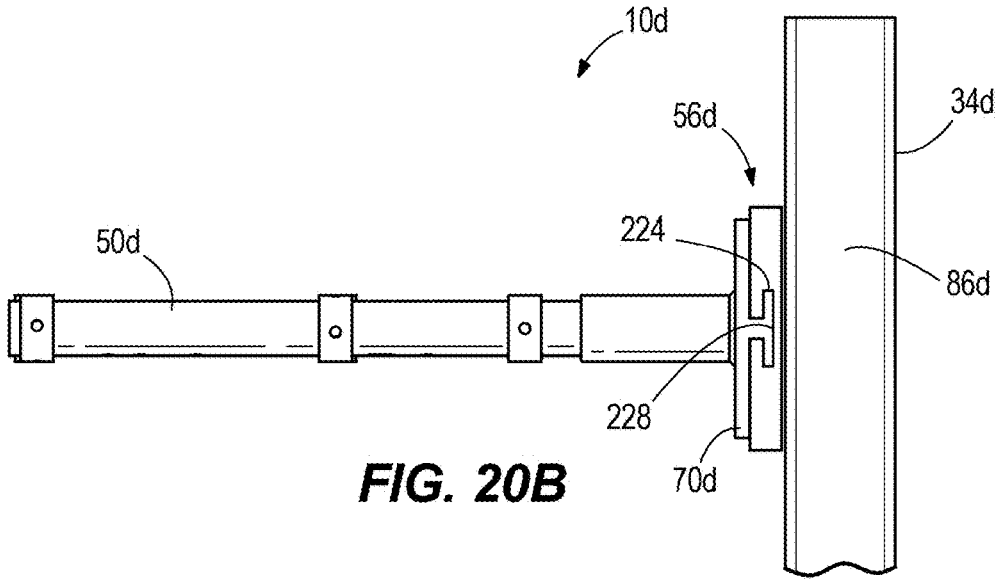

FIGS. 20A-20B illustrate another embodiment of a fixture carrier 10*d*, with like components designated with a "d". The fixture carrier 10*d* itself is mostly identical to the fixture carrier 10, while the first cross-bar 38 and the plates 66, 70 have been modified, as described below.

With continued reference to FIGS. 20A-20B, the first cross-bar 38*d* is rectangular and planar. The first end 37*d* of the first cross-bar 38*d* is coupled to the front face 78*d* of the first upright 30*d* and the second end 39*d* of the first cross-bar 38*d* is coupled to the front face 78*d* of the second upright 34*d*. The first cross-bar 38*d* further includes an elongate, T-shaped groove 224 extending along the length of the first cross-bar 38*d* along the longitudinal axis 94*d*.

In the illustrated embodiments, the first cross-bar 38*d* is permanently coupled to the uprights 30*d*, 34*d*. However, in alternative embodiments, the first cross-bar 38*d* may be removably coupled to the uprights 30*d*, 34*d*. In the illustrated embodiments, the frame 14*d* includes a single cross-bar 38*d*. However, in alternative embodiments, the frame 14*d* may include a second cross-bar 42*d*.

With continued reference to FIGS. 20A-20B, the first plate 66*d* is positioned between the first cross-bar 38*d* and the first arm 46*d*. The second plate 70*d* is positioned between the first cross-bar 38*d* and the second arm 50*d*. The plates 66*d*, 70*d* are rectangular in shape. The second face 67*d*, 71*d* of the plates 66*d*, 70*d* further include a T-shaped rib 228 corresponding to the groove 224. The ribs 228 of the plates 66*d*, 70*d* are configured to be slidingly received in the groove 224 of the first cross-bar 38*d* to inhibit the plates 66*d*, 70*d* from rotating relative to the first cross-bar 38*d*.

To position each of the plates 66*d*, 70*d* on the first cross-bar 38*d*, the user may position the rib 228 of the plate 66*d*, 70*d* into the groove 228 at the first end 37*d* of the first cross-bar 38*d* or at the second end 39*d* of the first cross-bar 38*d*. The user may slide each of the plates 66*d*, 70*d* along the groove 228 of the first cross-bar 38*d*. More specifically, the user may independently move (e.g., slide) the plates 66*d*, 70*d* relative to each other. For example, the user may slide the first plate 66*d* along the groove 224 toward the first end 37*d* of the first cross-bar 38*d*, or toward the second end 39*d* of the first cross-bar 38*d*. Similarly, the user may slide the second plate 70*d* along the groove 224 toward the first end 37*d* of the first cross-bar 38*d*, or toward the second end 39*d* of the first cross-bar 38*d*. As such, the user may selectively increase and/or decrease the distance between the plates 66*d*, 70*d*, and the distance between the arms 46*d*, 50*d*. Therefore, the width of the frame 14*d* may be adjusted via movement of the plates 66*d*, 70*d* along the first cross-bar 38*d*. Alternatively, the user may remove either the first plate 66*d* and/or the second plate 70*d* from the frame 14*d*.

Figure 21:
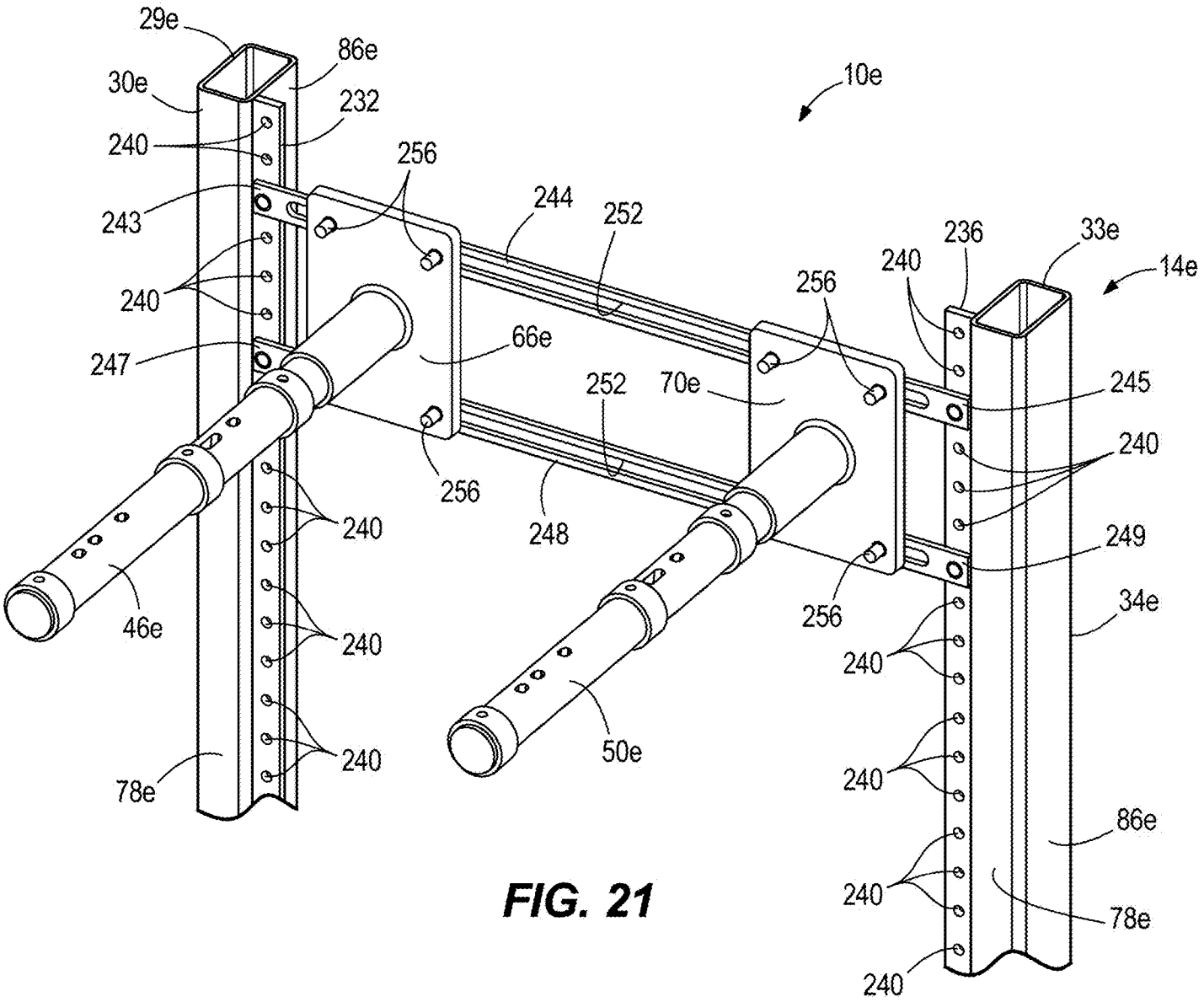
FIG. 21 is a front perspective view of another fixture carrier according to an embodiment of the present disclosure.

FIG. 21 illustrates another embodiment of a fixture carrier 10*c*, with like components designated with an "e". The fixture carrier 10*e* itself is largely identical to the fixture carrier 10, while the first cross-bar 38 and the plates 66, 70 have been modified, as described below.

With continued reference to FIG. 21, the first upright 30*e* includes a first support member 232 and the second upright 34*e* includes a second support member 236. The first support member 232 is positioned on the inner side face 86*e* of the first upright 30*e* and the second support member 236 is positioned on the inner side face 86*e* of the second upright 34*c*. The support members 232, 236 are rectangular and planar and extend along the length of the uprights 30*c*, 34*c*. Each of the support members 232, 236 include various apertures 240 extending through the support member 232, 236. The apertures 240 are shaped and sized to receive a fastener.

With continued reference to FIG. 21, the first cross-bar 38*e* includes a first rail 244 and a second rail 248, such that the rails are rectangular and planar. The first rail 244 includes a first end 243 and a second end 245 opposite the first end 243. Similarly, the second rail 248 includes a first end 247 and a second end 249 opposite the first end 247. The first ends 243, 247 of the rails 244, 248 are coupled to the first support member 232 and the second ends 245, 249 of the rails 244, 248 are coupled to the second support member 236. The first ends 243, 247 and second ends 245, 249 of the rails 244, 248 are coupled to the support members 232, 236 via a fastener. Specifically, the fasteners extend through the rails 244, 248 and through the corresponding apertures 240 on the support members 232, 236. Each of the rails 244, 248 further include an elongate slot 252 extending along the length of the rail 244, 248.

With continued reference to FIG. 21, each of the plates 66*e*, 70*e* include four studs 256 for securing the plates 66*e*, 70*e* to the first and second rails 244, 248. Specifically, the studs 256 extend through the first face 65*c*, 69*e* and the second face 67*e*, 71*e* of the plates 66*c*, 70*e* and protrude from the plates 66*e*, 70*e*. The studs 256 are shaped and sized to protrude into the elongate slots 252 of the first and second rails 244, 248.

To position the plates 66, 70*e* on the rails 244, 248, the user may position two of the studs 256 of the plate 66*e*, 70*e* into the elongate slot 252 of the first rail 244, and position the other of the two of the studs 256 of the plate 660, 70*e* into the elongate slot 252 of the second rail 248. Fasteners are secured to the ends of the studs 256 in order to secure the plate 660, 70*e* to the rails 244, 248. The user may slide the plates 660, 70*e* along the slots 252 of the rails 244, 248. More specifically, the user may independently move (e.g., slide) the plates 66*e*, 70*e* relative to each other. For example, the user may slide the first plate 66*e* along the slots 252 toward the first end 243, 247 of the first and second rails 244, 248, or toward the second end 245, 249 of the first and second rails 244, 248. Similarly, the user may slide the second plate 70*e* along the slots 252 toward the first end 243, 247 of the first and second rails 244, 248, or toward the second end 245, 249 of the first and second rails 244, 248. As such, the user may selectively increase and/or decrease the distance between the plates 66*e*, 70*e*, and the distance between the arms 46*e*, 50*c*. Therefore, the width of the frame 14*e* may be adjusted via movement of the plates 66, 70*e* along the first and second rails. Alternatively, the user may remove either the first plate 66*e* and/or the second plate 70*e* from the frame 14*c*.

Figure 22:
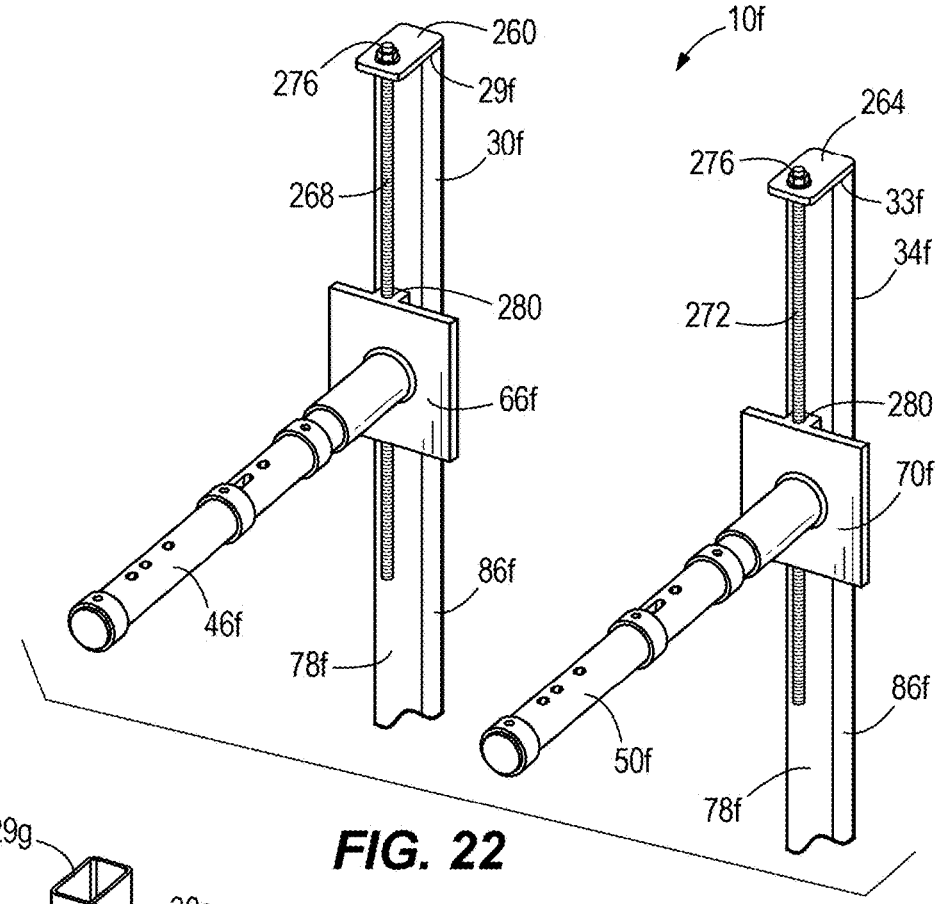
FIG. 22 is a front perspective view of another fixture carrier according to an embodiment of the present disclosure.

FIG. 22 illustrates another embodiment of a fixture carrier 10*f*, with like components designated with an "f". The fixture carrier 10*f* itself is mostly identical to the fixture carrier 10, while the uprights 30, 34 and the plates 66, 70 have been modified, as described below.

With continued reference to FIG. 22, the first end 29*f* of the first upright 30*f* includes a first top plate 260 and the first end 33*f* of the second upright 34*f* includes a second top plate 264. The first top plate 260 is coupled to a first elongate threaded rod 268, and the second top plate 264 is coupled to a second elongate threaded rod 272. The threaded rods 268, 272 extend substantially parallel to the front face 78*f* of the uprights 30*f*, 34*f*. A fastener 276 is positioned on the top plates 260, 264 to secure the threaded rods 268, 272 to the top plates 260, 264.

With continued reference to FIG. 22, the top edge 126*f* of the plate 66*f*, 70*f* is provided with a threaded aperture 280 extending through the plate 66*f*, 70*f*. The threaded aperture 280 is shaped and sized to receive the threaded rods 268, 272. The plates 66*f*, 70*f* are positioned on the threaded rods 268, 272. Specifically, the threaded rods 268, 272 are inserted into the corresponding apertures 280 of the plate 66*f*, 70*f*. The user may move the plates 66*f*, 70*f* along the threaded rods 268, 272. For example, the user may rotate the threaded rods 268, 272 in a first direction (e.g., a clockwise direction), and/or a second direction (e.g., a counterclockwise direction). When the threaded rod 268, 272 is rotated in the first direction, the rod 268, 272 is rotated relative to the plate 66*f*, 70*f*, thereby causing the plate 66*f*, 70*f* to axially move in an upward direction toward the first end 29*f*, 33*f* of upright 30*f*, 34*f*. As such, when the threaded rod 268, 272 is rotated in the first direction, the distance between the plate 66*f*, 70*f* and the support surface is increased. Alternatively, when the threaded rod 268, 272 is rotated in the second direction, the rod 268, 272 is rotated relative to the plate 66*f*, 70*f*, thereby causing the plate 66*f*, 70*f* to axially move in a downward direction toward the second end 31*f*, 35*f* of the upright 30*f*, 34*f*. As such, when the threaded rod 268, 272 is rotated in the second direction, the the distance between the plate 66*f*, 70*f* and the support surface is decreased. Furthermore, the user may independently move the plates 66*f*, 70*f* relative to each other.

Figure 23:
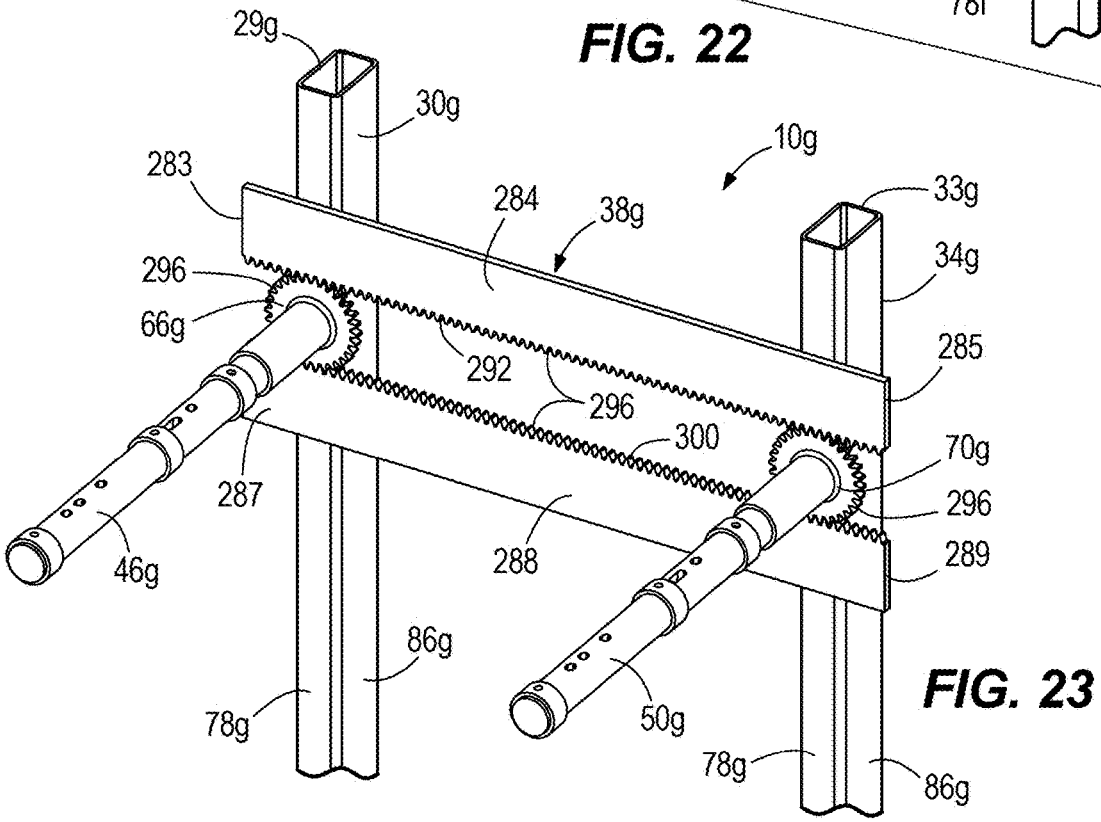
FIG. 23 is a front perspective view of another fixture carrier according to an embodiment of the present disclosure.

FIG. 23 illustrates another embodiment of a fixture carrier 10*g*, with like components designated with a "g". The fixture carrier 10*g* itself is mostly identical to the fixture carrier 10, while the first cross-bar 38 and the plates 66, 70 have been modified, as described below.

With continued reference to FIG. 23, the first cross-bar 38*g* includes a first, or top, portion 284, and a second, or bottom, portion 288. The first and second portions 284, 288 are rectangular and planar. The first portion 284 includes a first end 283 coupled to the front face 78*g* of the first upright 30*g* and a second end 285 coupled to the front face 78*g* of the second upright 34*g*. Similarly, the second portion 288 includes a first end 287 coupled to the front face 78*g* of the first upright 30*g* and a second end 289 coupled to the front face 78*g* of the second upright 34*g*. The first portion 284 includes a bottom edge 292 including various gear teeth 296. Similarly, the second portion 288 includes a top edge 300 including various gear teeth 296.

With continued reference to FIG. 23, the plates 66*g*, 70*g* are positioned between the first portion 284 and the second portion 288. The first plate 66*g* is positioned adjacent the first upright 30*g*, and the second plate 70*g* is positioned adjacent the second upright 34*g*. The plates 66*g*, 70*g* are circular in shape. The outer perimeter of the plates 66*g*, 70*g* include various gear teeth 296. The gear teeth 296 are shaped and sized to correspond to the gear teeth 296 on the first and second portions 284, 288 of the first cross-bar 38*g*. The plates 66*g*, 70*g* are positioned relative to the first and second portions 284, 288 such that the gear teeth 296 on the plates 66*g*, 70*g* are configured to mesh with the gear teeth 296 on the first and second portions 284, 288.

The user may move the plates 66*g*, 70*g* relative to the first and second portions 284, 288 of the first cross-bar 38*g*. Specifically, when a user applies force to the plate 66*g*, 70*g* in a first direction (e.g., toward the first upright 30*g*), and/or in a second direction (e.g., toward the second upright 34*g*), the gear teeth 296 on the plate 66*g*, 70*g* mesh with the gear teeth 296 on the first and second portions 284, 288, thereby causing rotation of the plate 66*g*, 70*g* relative to the first and second portions 284, 288. The user may independently move the plates 66*g*, 70*g* relative to each other. For example, the user may push the first plate 66*g* in the first direction and/or the second direction. Similarly, the user may push the second plate 70*g* in the direction and/or the second direction. As such, the user may selectively increase and/or decrease the distance between the plates 66*g*, 70*g*, and the distance between the arms 46*g*, 50*g*. Therefore, the width of the frame 14*g* may be adjusted via movement of the plates 66*g*, 70*g* along the first cross-bar 38*g*. Alternatively, the user may remove either the first plate 66*g* and/or the second plate 70*g* from the frame 14*d*.

Although the invention has been described in detail with reference to certain preferred embodiments, variations and modifications exist within the scope and spirit of one or more independent aspects of the invention as described. Various features and advantages are set forth in the following claims.

What is claimed is:

1. A fixture carrier for supporting a plumbing fixture, the fixture carrier comprising:

an upright;

a cross-bar coupled to the upright;

a bracket coupled to the upright, the bracket including a first side, a second side opposite the first side, and a third side extending between the first side and the second side, the first side, second side, and third side forming a pocket that extends around a portion of the upright, an end of the first side including a first flange, an end of the second side including a second flange;

a plate coupled to the bracket, the plate abutting the first flange and the second flange, the plate being slidable relative to the bracket; and an arm coupled to the plate and protruding in a direction that is orthogonal relative to the upright.

2. The fixture carrier of claim 1, wherein the bracket includes a fastener, wherein the plate includes an aperture, and wherein the aperture of the plate is configured to receive the fastener.

3. The fixture carrier of claim 1, wherein the upright is a first upright, and wherein the fixture carrier further comprises a second upright extending parallel to the first upright, wherein the cross-bar is positioned between the first upright and the second upright.

4. The fixture carrier of claim 3, wherein the bracket is a first bracket, and further comprising a second bracket coupled to the second upright, a second plate coupled to the second bracket, and a second arm coupled to the second plate.

5. The fixture carrier of claim 4, wherein the first bracket and the second bracket are independently movable relative to each other.

6. The fixture carrier of claim 1, wherein the plate is movable with the arm relative to the bracket, and wherein the plate is movable with the bracket relative to the upright.

7. The fixture carrier of claim 1, wherein the plate and bracket are releasably securable to one another around the upright.

8. The fixture carrier of claim 1, wherein the cross-bar is oriented in a direction orthogonal to both the upright and the arm, and wherein the plate is slidable relative to the bracket in a plane that is substantially parallel to the orientation of the cross-bar.

9. A fixture carrier for supporting a plumbing fixture, the fixture carrier comprising:

an upright extending in a first direction;

a cross-bar coupled to the upright;

a coupling mechanism including, a bracket coupled to the upright and movable in a direction parallel to the first direction, the bracket including a first side, a second side opposite the first side, and a third side extending between the first side and the second side, the first side, second side, and third side forming a pocket that at least partially encompasses the upright therein, an end of the first side including a first flange, an end of the second side including a second flange, and a plate coupled to the bracket, the plate abutting the first flange and the second flange, the plate being movable relative to the bracket, the plate including a receptacle horizontally offset from center relative to the plate;

an arm coupled to the receptacle of the plate, the arm extending in a second direction orthogonal to the first direction; and a sleeve positioned on the arm and slidable along at least a portion of a length of the arm.

10. The fixture carrier of claim 9, wherein the plate includes a slot extending through the plate, wherein the slot is configured to receive a fastener coupled to the bracket.

11. The fixture carrier of claim 10, wherein the plate is slidable along the slot relative to the bracket.

12. The fixture carrier of claim 9, wherein the arm is threadably coupled to the receptacle.

13. The fixture carrier of claim 9, wherein the sleeve is ring shaped and concentric to the arm.

14. A fixture carrier for supporting a plumbing fixture, the fixture carrier comprising:

an upright extending along a longitudinal axis oriented in a first direction;

a cross-bar coupled to the upright, the cross-bar extending in a second direction;

an arm extending in a third direction; and a coupling mechanism including a bracket removably coupled to the upright, a plate coupled to the bracket and the arm, and at least one fastener extending through the plate and the bracket, the fastener removably coupling the bracket to the plate;

wherein the bracket incudes a first flange and a second flange, the plate abutting the first flange and the second flange;

wherein the bracket and the plate are movable together along a length of the upright while the bracket and plate are unsecured relative to the upright, wherein the plate is movable relative to the upright laterally while the plate is unsecured relative to the upright, and wherein the bracket is slidable relative along a length of the upright but is restricted from moving in the second direction.

15. The fixture carrier of claim 14, wherein the arm includes a sleeve positioned on the arm, wherein the sleeve is slidable along the arm in a direction parallel to the third direction.

16. The fixture carrier of claim 15, wherein the arm includes a pin configured to removably couple the sleeve to the arm in a plurality of positions along the arm.

17. The fixture carrier of claim 14, further comprising:

a second upright oriented parallel to the first upright; and a second arm oriented parallel to the first arm.

18. The fixture carrier of claim 17, wherein the coupling mechanism is a first coupling mechanism, the fixture carrier further comprising a second coupling mechanism removably coupled to the second upright, wherein the second coupling mechanism couples the second arm to the second upright.

19. The fixture carrier of claim 18, wherein the first coupling mechanism and the second coupling mechanism are movable independently of one another.

20. The fixture carrier of claim 14, wherein the plate is movable relative to the bracket in a direction parallel to the second direction.

* * * * *